US012716143B2

(12) United States Patent
Lim et al.

(10) Patent No.: US 12,716,143 B2
(45) Date of Patent: Aug. 25, 2026

(54) SELECTIVE RECOVERY OF RARE EARTH ELEMENTS FROM ALLOYS BY ELECTROCHEMICAL LEACHING AND ELECTRODEPOSITION

(71) Applicant: Battelle Memorial Institute, Richland, WA (US)

(72) Inventors: Hyung-Seok Lim, Richland, WA (US); Wei Wang, Richland, WA (US); Vijayakumar Murugesan, West Richland, WA (US); Chinmayee Venkata Subban, Seattle, WA (US); Tasya S. Nasoetion, Sugar Land, TX (US)

(73) Assignee: Battelle Memorial Institute, Richland, WA (US)

( * ) Notice: Subject to any disclaimer, the term of this patent is extended or adjusted under 35 U.S.C. 154(b) by 576 days.

(21) Appl. No.: 18/300,313

(22) Filed: Apr. 13, 2023

(65) Prior Publication Data

US 2023/0332319 A1 Oct. 19, 2023

Related U.S. Application Data

(60) Provisional application No. 63/332,027, filed on Apr. 18, 2022.

(51) Int. Cl.

| | |
|---|---|
| ***C25C 1/22*** | (2006.01) |
| ***C25C 7/02*** | (2006.01) |
| ***C25C 7/06*** | (2006.01) |

(52) U.S. Cl.
CPC ..... *C25C 1/22* (2013.01); *C25C 7/02* (2013.01); *C25C 7/06* (2013.01)

(58) Field of Classification Search
CPC ..... C25C 1/22
See application file for complete search history.

(56) References Cited

U.S. PATENT DOCUMENTS

| | | | | |
|---|---|---|---|---|
| 2017/0335478 | A1* | 11/2017 | Chen | H01F 1/057 |
| 2019/0186031 | A1* | 6/2019 | Baek | C25C 7/06 |
| 2020/0168395 | A1* | 5/2020 | Xu | C22B 59/00 |
| 2021/0292870 | A1* | 9/2021 | Case | C25C 3/34 |
| 2025/0236982 | A1* | 7/2025 | Thapaliya | C25D 3/54 |
| 2025/0343291 | A1* | 11/2025 | McNally | H01M 4/505 |

FOREIGN PATENT DOCUMENTS

JP 2014111802 A * 6/2014

OTHER PUBLICATIONS

Machine translation of JP 2014-111802 A (Year: 2014).*
Lim et al, Room Temperature Electrorefining of Rare Earth Metals from End-of-Use Nd—Fe—B Magnets, ACS Sustainable Resource Management, vol. 1, No. 2, Jan. 2024, pp. 269-277 (Year: 2024).*
Yang et al, Recovery of rare-earth element from rare-earth permanent magnet waste by electro-refining in molten fluorides, Separation and Purification Technology, vol. 233, Feb. 2020, 116030, pp. 1-10 (Year: 2020).*
Graphical abstract of Yang et al., Recovery of rare-earth element from rare-earth permanent magnet waste by electro-refining in molten fluorides, obtained at https://www.sciencedirect.com/science/article/pii/S1383586619314108 (Year: 2020).*
Xu et al, Direct Recycling of Nd—Fe—B Magnets Based on the Recovery of Nd2Fe14B Grains by Acid-free Electrochemical Etching, ChemSusChem, vol. 12, No. 21, Nov. 2019, pp. 4754-4758 (Year: 2019).*
Graphical abstract of Xu et al, Direct Recycling of Nd—Fe—B Magnets Based on the Recovery of Nd2Fe14B Grains by Acid-free Electrochemical Etching, obtained at https://chemistry-europe.onlinelibrary.wiley.com/doi/10.1002/cssc.201902342 (Year: 2019).*
Panchenko et al, The effect of lithium salt concentration in an aprotic solvent on the oxygen reaction, Electrochimica Acta, vol. 393, Oct. 2021, 139073, pp. 1-8 (Year: 2021).*
Xu et al, Sulfone-Based Electrolytes for Lithium-Ion Batteries, Journal of The Electrochemical Society, vol. 149, No. 7, May 2002, pp. A920-A926 (Year: 2002).*
Geysens et al., "Electrodeposition of neodymium and dysprosium from organic electrolytes," *Phys Chem. Chem. Phys.*, Apr. 6, 2021, 23:9070-9079.
Lee et al., "Selective Leaching Process for Neodymium Recovery from Scrap Nd—Fe—B Magnet," *Metallurgical and Materials Transactions A*, Dec. 2013 (Published online Sep. 6, 2013), 44A:5825-5833.
Lu et al., "Nd—Fe—B Magnets: The Gradient Change of Microstructures and the Diffusion Principle after Grain Boundary Diffusion Process," *Materials*, Nov. 24, 2019, 12:3881, 10 pages.
Onal et al., "Hydrometallurgical recycling of NdFeB magnets: Complete leaching, iron removal and electrolysis," *Journal of Rare Earths*, May 2017, 35(5):574-584.
Rabatho et al., "Recovery of Nd and Dy from rare earth magnetic waste sludge by hydrometallurgical process," *Journal of Material Cycles and Waste Management*, 2013 (published online Dec. 11, 2012), 15:171-178.
Reisdorfer et al., "Recovery of neodymium from the magnets of hard disk drives using organic acids," *Minerals Engineering*, Aug. 22, 2019, 143:105938, 10 pages.
Sun et al., "Separation of neodymium and dysprosium from nitrate solutions by solvent extraction with Cyanex272," *Minerals Engineering*, Jan. 6, 2018, 118:9-15.

(Continued)

*Primary Examiner* — Harry D Wilkins, III
(74) *Attorney, Agent, or Firm* — Klarquist Sparkman, LLP

(57) ABSTRACT

A method for selectively recovering a rare earth element (REE) from an alloy includes applying a potential of from −3.5 V to 0 V to an electrochemical cell comprising a anode, a cathode, and an electrolyte, wherein (i) the anode comprises an alloy comprising a REE, (ii) the cathode comprises a noble metal, and (iii) the electrolyte comprises an alkali metal or alkaline earth metal salt and a nonaqueous solvent. Under the applied potential, at least some of the REE is oxidatively dissolved from the anode and is electrodeposited onto the cathode to form an REE deposit.

20 Claims, 14 Drawing Sheets
(14 of 14 Drawing Sheet(s) Filed in Color)

(56) References Cited

OTHER PUBLICATIONS

Vander Hoogerstraete et al., "From NdFeB magnets towards the rare-earth oxides: a recycling process consuming only oxalic acid," *RSC Advances*, Nov. 14, 2014, 4:64099-64111.

Yang et al., "REE Recovery from End-of-Life NdFeB permanent Magnet Scrap: A Critical Review," *J. Sustain. Metall.* 2017 (published online Sep. 20, 2016), 3:122-149.

Yoon et al., "The Effect of Grinding and Roasting Conditions on the Selective Leaching of Nd and Dy from NdFeB Magnet Scraps," *Metals*, Jul. 17, 2015, 5:1306-1314.

Xu et al., "Liquid metal extraction of Nd from NdFeB magnet scrap," *Journal of Materials Research*, Nov. 2000 (published online Jan. 31, 2011), 15(11):2296-2304.

* cited by examiner

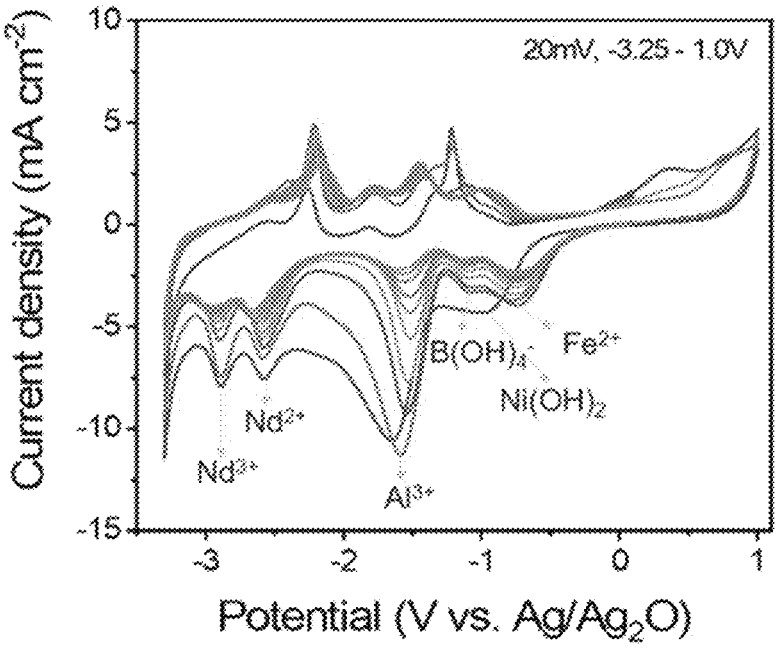
FIG. 3
FIG. 4A
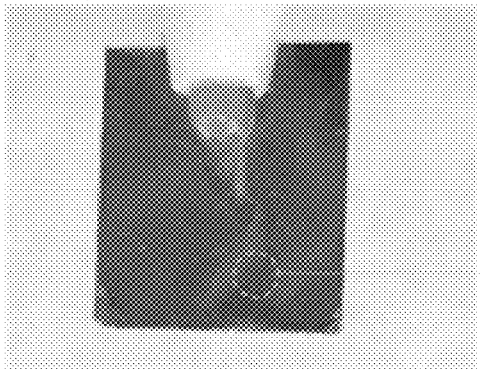
FIG. 4B
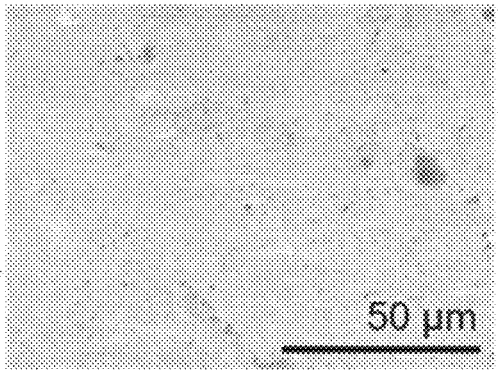
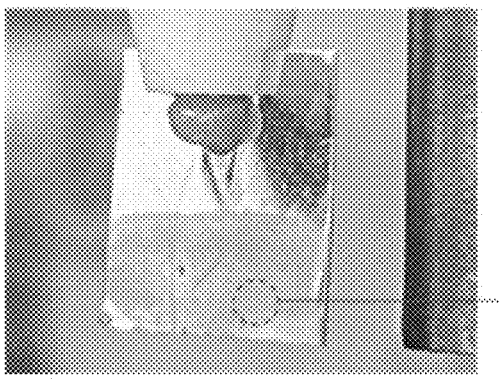
FIG. 4C
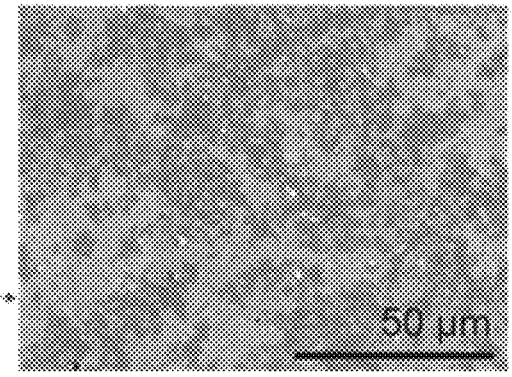
FIG. 4D

4

SELECTIVE RECOVERY OF RARE EARTH ELEMENTS FROM ALLOYS BY ELECTROCHEMICAL LEACHING AND ELECTRODEPOSITION

CROSS REFERENCE TO RELATED APPLICATION

This application claims the benefit of the earlier filing date of U.S. Provisional Application No. 63/332,027, filed Apr. 18, 2022, which is incorporated by reference in its entirety herein.

ACKNOWLEDGMENT OF GOVERNMENT SUPPORT

This invention was made with government support under AC0576RL01830 awarded by U.S. Department of Energy. The government has certain rights in the invention.

FIELD

This disclosure concerns aspects of an electrochemical method for selectively recovering rare earth elements from alloys.

BACKGROUND

Using rare earth metal-based alloys in many modern technologies relies on environmentally taxing mining processes for raw material followed by energy- and chemical-intensive manufacturing processes. Despite this, tons of rare earth metals, mostly in the form of permanent magnets such as Nd—Fe—B alloy magnets, are thrown in landfills as used consumer and industrial products, often after their first life cycle. The Nd—Fe—B alloy-based permanent magnet is a ubiquitous component of modern energy technologies, ranging from industrial motors (e.g., hybrid and electric vehicles) and automation, consumer electronics (e.g., optical drives, smart phones), and wind turbines. The size of these magnets ranges from less than 1 g in portable electronics to well over 1000 kg in the generators of wind turbines, with each magnet containing about 32 wt. % of rare earth elements (REEs) such as neodymium (Nd), dysprosium (Dy) and praseodymium (Pr). In 2011, the U.S. Department of Energy categorized neodymium as a critical element. An element is classified as "critical" because of its rarity in the earth's crust and/or lack of availability in the U.S. With increased electrification and reliance on clean energy, the demand for Nd is expected to grow significantly. It is estimated that without efficient reuse or development of alternative technologies, renewable energy and electric transportation over the next 25 years will require a 700% increase in Nd supply.

One promising approach for increasing REE supply, such as Nd supply, is recycling REEs from REE-containing alloys, such as permanent magnets. Direct recycling of permanent magnets has been shown to result in decreased magnet performance. Thus, REE recovery and reuse is preferred. Recovering REEs from used permanent magnets or other REE-containing alloys has been a persistent technological challenge. Current recycling methods rely on pyrometallurgical or hydrometallurgical processes which are energy- and chemical-intensive and are not economically and environmentally viable for REE-containing magnets and other REE-containing alloys. For example, Nd can be recovered from Nd—Fe—B alloys through pyrometallurgical methods including a roasting pre-treatment (>450° C. in NaOH) or through liquid metal extraction using molten magnesium at 700° C. Alternatively, hydrometallurgical recycling processes, which can be used at room temperature, require multiple processing steps and total dissolution of the alloy in strong acids, followed by selective separation of REEs by solvent extraction, membrane-assisted solvent extraction, or membrane electrolysis. The separated REEs are subsequently precipitated and calcined. However, even with these methods, the recovered REEs are often in an oxidized form ($Ln^{3+}$) necessitating re-metallization process through high temperature (≥500° C.) electrowinning or metallothermic reduction, adding further environmental and economic costs. Enabling efficient and simplistic recovery and refining of REEs contained in end-of-use (EU) products, such as Nd—Fe—B alloy-based magnets will play an important and complementary role in the total supply of REEs in the future.

SUMMARY

Aspects of an electrochemical method for selectively recovering rare earth elements from alloys are disclosed. In some aspects, the method includes applying a potential of from −3.5 V to 0 V to an electrochemical cell comprising a anode, a cathode, and an electrolyte, wherein (i) the anode comprises an alloy comprising a REE, (ii) the cathode comprises a noble metal, and (iii) the electrolyte comprises an alkali metal or alkaline earth metal salt and a nonaqueous solvent. Under the applied potential, at least some of the REE is oxidatively dissolved from the anode and is electrodeposited onto the cathode to form an REE deposit. In certain implementations, the potential is effective to provide continuous oxidative dissolution and electrodeposition of the REE.

In any of the foregoing or following aspects, the REE may comprise La, Ce, Pr, Nd, Pm, Sm, Eu, Gd, Tb, Dy, Ho, Er, Tm, Yb, Lu, or any combination thereof. In some aspects, the REE comprises Nd, or Nd in combination with one or more additional REEs. The alloy may comprise from 1 at % to 99 at % of the REE. In some aspects, the REE deposit comprises at least 95 at % of the REE.

In any of the foregoing or following aspects, the alloy may be a Nd—Fe—B alloy. In some aspects, the Nd—Fe—B alloy is obtained from a permanent magnet. In such aspects, the method may further comprise demagnetizing the permanent magnet prior to applying the potential.

In any of the foregoing or following aspects, the electrolyte may comprise from 0.001 M to 0.1 M of the alkali metal or alkaline earth metal salt. In some aspects, the alkali metal or alkaline earth metal salt comprises a lithium salt, a sodium salt, a potassium salt, a cesium salt, or any combination thereof. In some implementations, the nonaqueous solvent comprises dimethylformamide (DMF), an ether, or a combination thereof.

The foregoing and other objects, features, and advantages of the disclosure will become more apparent from the following detailed description, which proceeds with reference to the accompanying figures.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 3 shows cyclic voltammograms (CVs) of a Nd—Fe—B magnet versus a Pt counter electrode performed at a scan rate of 20 mV s-1 for 10 cycles in the potential range −3.25V-1.0V vs. $Ag/Ag_2O$ with 0.1 M LiCl in DMF electrolyte.

FIGS. 4A-4D show digital photographs (FIGS. 4A, 4C) and SEM images (FIGS. 4B, 4D) of the Pt electrode of FIG. 3 before (FIGS. 4A, 4B) and after (FIGS. 4C, 4D) the CV cycles.

In FIGS. 7B-7D, regions used for section analysis are highlighted in green, purple and pink, and correspond to depth profile in panels 2, 3, and 4 respectively.

DETAILED DESCRIPTION

Figure 1:
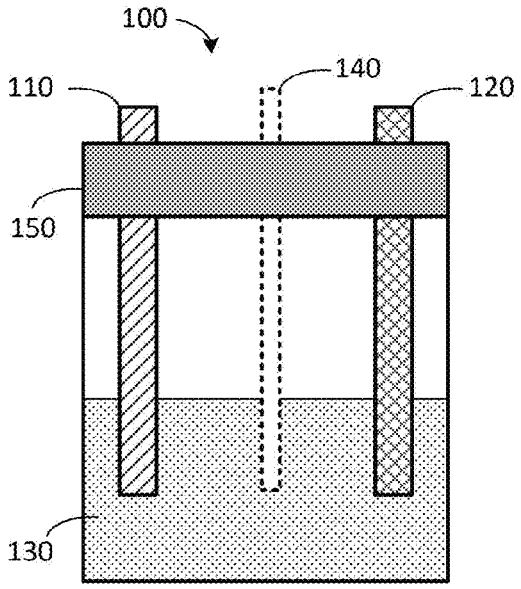
FIG. 1 is a schematic diagram of an electrochemical cell.

Aspects of an electrochemical process to selectively recover rare earth elements (REEs), or lanthanides, from alloys are disclosed. The REEs are selectively separated from the alloy and concurrently deposited. In some aspects, the process is performed at ambient temperature (e.g., 20° C.-25° C.) and may be a one-step, "one-pot" process. The REEs may be selectively leached from an alloy comprising additional metals and deposited as a pure REE or REE alloy. In some implementations, Nd is selectively leached from a Nd—Fe—B alloy-based permanent magnet and electrodeposited. In certain implementations, the Nd—Fe—B alloy includes one or more additional REEs, such as Pr, which are also separated and deposited. In some examples, Nd and Pr are electrodeposited as a didymium alloy. Aspects of the disclosed process overcome the scientific challenges associated with achieving a combined electrochemical separation and refining of REEs. These challenges include (1) the very high negative redox potential of REEs, which leads to intense parasitic reactivity with electrolyte, and (2) high activation barriers for diffusion, hampering transport and transfer of trivalent lanthanide ions ($Ln^{3+}$) across interfaces.

I. Definitions and Abbreviations

The following explanations of terms and abbreviations are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following detailed description and the claims.

The disclosure of numerical ranges should be understood as referring to each discrete point within the range, inclusive of endpoints, unless otherwise noted. Unless otherwise indicated, all numbers expressing quantities of components, molecular weights, percentages, temperatures, times, and so forth, as used in the specification or claims are to be understood as being modified by the term "about." Accordingly, unless otherwise implicitly or explicitly indicated, or unless the context is properly understood by a person of ordinary skill in the art to have a more definitive construction, the numerical parameters set forth are approximations that may depend on the desired properties sought and/or limits of detection under standard test conditions/methods as known to those of ordinary skill in the art. When directly and explicitly distinguishing embodiments from discussed prior art, the embodiment numbers are not approximates unless the word "about" is recited.

Although there are alternatives for various components, parameters, operating conditions, etc. set forth herein, that does not mean that those alternatives are necessarily equivalent and/or perform equally well. Nor does it mean that the alternatives are listed in a preferred order unless stated otherwise.

Definitions of common terms in chemistry may be found in Richard J. Lewis, Sr. (ed.), *Hawley's Condensed Chemical Dictionary*, published by John Wiley & Sons, Inc., 2016 (ISBN 978-1-118-13515-0). In order to facilitate review of the various embodiments of the disclosure, the following explanations of specific terms are provided:

Alloy: A solid mixture of two or more metals, or of one or more metals with certain nonmetallic elements (e.g., carbon steels).

Anode: An electrode through which electric charge flows into a polarized electrical device. From an electrochemical point of view, negatively-charged anions move toward the anode and/or positively-charged cations move away from it to balance the electrons leaving via external circuitry.

Cathode: An electrode through which electric charge flows out of a polarized electrical device. From an electrochemical point of view, positively charged cations invariably move toward the cathode and/or negatively charged anions move away from it to balance the electrons arriving from external circuitry.

Cell or electrochemical cell: As used herein, a cell refers to an electrochemical device in which a chemical reaction is induced by a current.

Cell potential: The cell potential, or voltage, is the charge difference between two electrodes of an electrochemical cell.

Rare earth element (REE): As used herein, the term rare earth element refers to Sc and Y, as well as elements within the lanthanide series of the periodic table: La, Ce, Pr, Nd, Pm, Sm, Eu, Gd, Tb, Dy, Ho, Er, Tm, Yb, and Lu. The terms REE and lanthanide may be used interchangeably herein. Specifically, the notation "Ln" may encompass any element within the lanthanide series, plus Sc and Y.

II. Selective Recovery of Rare Earth Elements from Alloys

Aspects of a method for recovering a rare earth element (REE) from an alloy are disclosed. REEs are selectively recovered from the alloy in an electrochemical process. In some aspects, the REEs are recovered from a permanent magnet, such as a Nd—Fe—B permanent magnet, often simply referred to as a neodymium magnet.

FIG. 1 is a schematic diagram of an exemplary electrochemical cell 100 useful for carrying out aspects of the disclosed method for selective recovery of REE(s) from alloys. The cell 100 includes an anode 110, a cathode 120, and an electrolyte 130. In some aspects, the cell 100 may further include a reference electrode 140. In certain implementations, the cell 100 further comprises a cover 150 so that the cell may be maintained under an inert atmosphere (e.g., $N_2$, argon).

In some aspects, the method for recovering a rare earth element (REE) from an alloy includes applying a potential of from −3.5 V to 0 V to an electrochemical cell comprising a anode, a cathode, and an electrolyte, wherein (i) the anode comprises an alloy comprising a REE, (ii) the cathode comprises a noble metal, and (iii) the electrolyte comprises an alkali metal or alkaline earth metal salt and a nonaqueous solvent. When the potential is applied, at least some of the REE is oxidatively dissolved from the anode and is electrodeposited onto the cathode to form an REE deposit.

Advantageously, the electrochemical process is a one-pot process that does not require extreme temperature or reaction conditions. Additionally, the process is scalable, based on widely available electrolyte components, and does not require consumable reactants. Aspects of the disclosed process provide both atom and energy efficiency, reduce industrial energy consumption, and/or reduce $CO_2$ emission compared to traditional methods of REE recovery. Aspects of the disclosed process also provide a pathway for a circular supply chain of REEs.

In any of the foregoing or following aspects, the method may be performed at ambient temperature, e.g., room temperature, such as 20° C. to 25° C. In some aspects, the method is performed under an inert atmosphere.

The potential may be selected by performing cyclic voltammetry in the electrochemical cell over a potential range to determine a potential at which selective oxidative dissolution and electrodeposition of the REE occurs. A rise in current density is observed when the potential oxidatively dissolves the REE. The oxidative potential of an REE in an alloy depends on the local composition and is more positive than the corresponding potential of the individual metal. Advantageously, the potential is effective for selectively leaching REEs from the alloy without also leaching the base metals, such as Fe, B, and the like. In general, the oxidation potential of many lanthanides is about-2.3 V (vs. Ag/AgCl), which is significantly lower than the oxidation potential of other common metals, such as iron and boron. The difference in oxidation potentials enables excellent selectivity in electrolytic dissolution, particularly when a relatively narrow voltage window is utilized. In some aspects, the potential and/or dissolution rate depends in part on microstructural features of the alloy. In some examples, REEs are selectively recovered from the alloy at a potential within a range of −3.5 V to −2.5 V. In any of the foregoing or following aspects, the applied potential may be effective to provide continuous oxidative dissolution of the REE from the alloy anode and concurrent electrodeposition of the REE onto the cathode.

The anode comprises an alloy including one or more REEs. In any of the foregoing or following aspects, the REE may comprise La, Ce, Pr, Nd, Pm, Sm, Eu, Gd, Tb, Dy, Ho, Er, Tm, Yb, Lu, or any combination thereof. In some implementations, the REE comprises Nd or Nd in combination with one or more additional REEs. In certain aspects, the REE comprises Nd in combination with Pr and/or Gd. Aspects of the disclosed method are useful for alloys comprising from 1 at % to 99 at % of the REE. In some aspects, the alloy includes REEs in range having endpoints selected from 1 at %, 5 at %, 10 at %, 20 at %, 25 at %, 30 at %, 40 at %, 50 at %, 60 at %, 70 at %, 80 at %, 90 at %, 95 at %, and 99 at %, such as from 5 at % to 95 at %, 10 at % to 90 at %, 10 at % to 70 at %, 10 at % to 50 at %, or 15 at % to 50 at %, wherein the amounts include nominal and/or measured amounts.

In some embodiments, the alloy is a permanent magnet. The permanent magnet may be a neodymium magnet, such as a Nd—Fe—B magnet. The Nd—Fe—B alloy may comprise a tetragonal crystalline structure of $Nd_2Fe_{14}B$. The alloy may further include additional REEs embedded within the crystalline structure, such as Pr and/or Gd. In one example, a Nd—Fe—B magnet included 20 wt % Nd (11 at %), 7.4 wt % Gd (3.7 at %), and 4.6 wt % Pr (2.6 at %) embedded within the $Nd_2Fe_{14}B$ phase. The permanent magnet may be an end-of-use (EoU) magnet. An EoU magnet may be demagnetized. In some aspects, the permanent magnet remains magnetic, and the method may further comprise demagnetizing the permanent magnet prior to applying the potential. In certain aspects, a surface of the permanent magnet may be at least partially oxidized, and the method may further comprise polishing the magnet surface to remove any oxidation prior to applying the potential.

When the potential is applied to the electrochemical cell, at least some of the REE is selectively oxidatively dissolved from the anode and is electrodeposited onto the cathode to form an REE deposit. When the alloy is a Ln-Fe—B alloy (e.g., a Nd—Fe—B alloy), the following reactions occur in which Ln represents the lanthanides, or REEs. As shown in Eqs. 1 and 2, the lanthanide Ln is selectively stripped from the alloy (anode), solvated by the electrolyte solvent, and then reduced and electrodeposited onto the cathode. When the alloy is a Nd—Fe—B alloy, the lanthanides include Nd and may further include additional REEs, such as Pr and/or Gd. The principle reactions of Eqs. 1 and 2 are not limited to Ln-Fe—B alloys, and apply equally to other REE-containing alloys.

$$[\text{Ln—Fe—B}]_s^0 \rightarrow [\text{Ln}]_l^{3+} + [\text{Fe—B}]_s + 3e^- - \text{Anode} \quad (1)$$

$$[\text{Ln}]_l^{3+} + 3e^- \rightarrow [\text{Ln}]_s^0 - \text{Cathode} \quad (2)$$

Because the potential provides selective oxidative dissolution of the REE, the REE deposit may comprise at least 95 at % of the REE. In some aspects, the REE deposit comprises 95 at % to 100 at % of the REE, such as 95 at % to 99.9 at %, 95 at % to 99.5 at %, wherein the amounts include nominal and/or measured amounts. In some implementations, when referring to the REE deposit, the at % is a measured amount. When the anode alloy comprises two or more REEs, the REE deposit may comprise an REE alloy. For example, when the anode comprises both Nd and Pr, the REE deposit may comprise a didymium alloy (a Nd— and Pr-based alloy), which is widely used in magnets and glass filter manufacturing.

In some aspects, the REE deposit may further comprise small amounts of other metals. For example, when the anode alloy is a Nd—Fe—B alloy, the REE deposit may comprise small amounts of iron. Iron may be adsorbed to the surface of the REE deposit and/or small amounts of $Fe^{3+}$ may be co-leached and deposited. Without being limited to a single operating theory, it currently is believed that the presence of some $Fe^{3+}$ in the electrolyte during the electrochemical process suggests that dissolution-induced dealloying may induce some leaching of residual iron from Ln-rich grains and grain boundary regimes in the alloy.

In any of the foregoing or following aspects, the cathode comprises a noble metal. In some aspects, the noble metal comprises Pt, Au, Ag, Ir, Os, Pd, Re, Ru, or Rh, or any combination thereof. In certain implementations, the cathode comprises Pt or Au. In some examples, the cathode comprises Pt.

In any of the foregoing or following aspects, the electrochemical cell includes an electrolyte comprising an alkali metal or alkaline earth metal salt and a nonaqueous solvent. A concentration of the alkali metal or alkaline earth metal salt may be from 0.001 M to 1 M. In some aspects, the concentration is within a range having endpoints selected from 0.001 M, 0.005 M, 0.01 M, 0.05 M, 0.1 M, 0.15 M, 0.2 M, 0.3 M, 0.4 M, 0.5 M, 0.6 M, 0.7 M, 0.8 M, 0.9 M, and 1 M. For example, the concentration may be from 0.01 M to 1 M, 0.05 M to 1 M, 0.1 M to 1 M, or 0.1 M to 0.5 M.

In any of the foregoing or following aspects, the alkali metal or alkaline earth metal salt may comprise a lithium salt, a sodium salt, a potassium salt, a cesium salt, or any combination thereof. In some implementations, the salt comprises a lithium salt, a sodium salt, or a combination thereof. Advantageously, $Li^+$ has a potential. In some aspects, the salt comprises LiCl, NaCl, $LiClO_4$, or any combination thereof. In certain implementations, the salt comprises LiCl or $LiClO_4$. In an independent implementation, the salt comprises anhydrous NaCl.

In any of the foregoing or following aspects, the nonaqueous solvent may comprise dimethylformamide (DMF), tetrahydrofuran (THF), acetonitrile (ACN), hexamethylphosphoramide, an ether, or a combination thereof. In some aspects, the ether comprises 1,2-dimethoxyethane (DME), 2-methyltetrahydrofuran, diethylene glycol dimethyl ether (DEGDME, or diglyme), triethylene glycol dimethyl ether (triglyme), tetraethylene glycol dimethyl ether (tetraglyme), 1,3-dioxolane (DOL), allyl ether, a fluorinated ether (methyl nonafluorobutyl ether, 1,1,2,2-tetrafluoroethyl 2,2,2-trifluoroethyl ether, bis(2,2,2-trifluoroethyl) ether, difluoromethyl 2,2,3,3-tetrafluoropropyl ether, ethyl-1,1,2,2-tetrafluoroethyl ether, ethyl-1,1,2,3,3,3-hexafluoropropyl ether, hexafluoroisopropyl methyl ether) or any combination thereof. In certain implementations, the nonaqueous solvent comprises DMF.

Advantageously, the electrolyte is stable throughout the electrochemical process and has little or no participation in parasitic reactions with the depositing REEs, thereby minimizing or avoiding formation of passivating layers on the cathode and/or REE deposit. In some examples, the electrolyte comprises LiCl or $LiClO_4$ in DMF, such as 0.1 M LiCl in DMF or 0.1 M $LiClO_4$ in DMF.

In particular aspects, a method for recovering neodymium from an alloy includes applying a potential of from −3.5 V to −2.5 V to an electrochemical cell comprising a anode, a cathode, and an electrolyte, wherein (i) the anode comprises an alloy comprising Nd, (ii) the cathode comprises Pt or Au, and (iii) the electrolyte comprises 0.1 M to 1 M LiCl and a nonaqueous solvent comprising DMF or an ether, whereby at least some of the Nd is leached from the anode and is electrodeposited onto the cathode. In certain implementations, the anode comprises a Nd—Fe—B alloy, such as a demagnetized Nd—Fe—B alloy. The Nd—Fe—B alloy may be a permanent magnet, e.g., an end-of-life permanent magnet.

III. Examples

Methods

Materials: Lithium chloride (LiCl, 99.99%, battery grade) and N,N-dimethylformamide (DMF, 99.8%, anhydrous) were purchased from Sigma-Aldrich. Platinum plate electrodes (purity 99.99%), silver (99.99%) and platinum wires (99.99%) were used as electrodes after surface polishing. The uncoated neodymium-iron-boron (Nd—Fe—B) permanent magnet rods (35NERR16-2, grade-35, diameter: 0.25 in, length: 2 in) were purchased from MagnetShop.com, Culver City, CA. The Nd—Fe—B discs were cut from the magnet rod using a diamond cutter and demagnetized by annealing at 400° C. for 30 minutes in a vacuum to avoid oxidation. The demagnetized samples were polished using sandpaper up to 1200 grit to remove surface coatings. The final polishing was done using a vibratory polisher in a 0.06 μm amorphous colloidal silica suspension for 2-3 hours. In examples described herein, "s" means "seconds" and "h" means "hours" (when used in the context of a time parameter).

Electrochemical measurements: All electrochemical measurements were performed at ambient temperature conditions in an argon filled glovebox. A 3-electrode glass electrochemical cell (FIG. 1) used in the study contained a polished Nd—Fe—B permanent magnetic rod as counter electrode (anode), a platinum (Pt) plate as working electrode (cathode), and a silver wire as pseudo reference electrode. The cell was filled with approximately 15 mL of 0.1 M LiCl/DMF electrolyte prior to voltage cycling in the different voltage ranges vs. $Ag/Ag_2O$. The surface of the silver wire was polished and dried before use. Cyclic voltammetry (CV) measurements were performed using a potentiostat (GAMRY, Interface 1000). Polarization curves were recorded at a potential sweep rate of 20 mV/s and 5 mV/s between-2.8 V to 1V vs. $Ag/Ag_2O$. Observed reduction and oxidation peaks were converted to standard reduction potential values (E°) using a modified Nernst equation (E°)= $E_{Ag/Ago2}+E^{\circ}_{Ag/AgO2}$), with $E^{\circ}_{Ag/AgO2}$=0.342 V, and the assumption that there is not significant difference in pH between the experimental and standard reduction potential values. The chronoamperometry technique with constant potentials and over extended times were performed to investigate the effect of electrodeposition parameters on the selectivity and growth of the REMs on the platinum working electrode. The polished magnet discs (diameter: 0.2 in, thickness: 2 mm) connected with a Pt wire were used as a counter electrode. After the potentiostatic measurement, the electrodes were rinsed with fresh DMF and dried in a vacuum for the characterizations.

Characterization: Scanning electron microscopy (SEM) coupled with energy dispersive x-ray analysis (EDX), and X-ray photoelectron spectroscopy (XPS) were performed to analyze the morphology and composition of electro-dissolution and deposition products. The microstructure and associated elemental composition analysis was performed using FEI Quanta™ 3D focused ion beam scanning electron microscopy (FIB-SEM) (FEI Company, Hillsboro, OR) coupled with energy dispersive x-ray analysis (EDX). The EDX elemental composition was characterized by energy-dispersive X-ray spectroscopy at an accelerating voltage of 10 KV. After electrochemical deposition, the Pt electrode was washed with fresh DMF for 30 seconds and dried in an argon-filled glovebox with moisture and oxygen concentrations below 5 ppm. The samples were then transferred to an X-ray photoelectron spectroscopy (XPS) analysis chamber through an in-built load-lock within the glove box. The XPS data were collected using a Kratos AXIS Ultra DLD spectrometer (Kratos Analytical Ltd., Manchester, UK), which equipped with an Al Kα monochromatic X-ray source (1486.6 eV) and a high-resolution spherical mirror analyzer. The X-ray source was operated at 150 W power and the emitted photoelectrons were collected at the analyzer entrance slit normal to the sample surface. The 2D XPS imaging data acquisition was carried out in a hybrid mode with an analysis area of 800×800 $\mu m^2$. High energy resolution photoelectron spectra were collected using a pass energy of 40 eV with a step size of 0.1 eV. To remove the surface layer and study the sub-surface chemical composition, the deposited sample was cleaned using 2 KeV Ar ion sputtering for 30 min. The XPS spectra were analyzed using the CasaXPS software (Casa Software Ltd.) with mixed Gaussian/Lorentzian [GL (30)] line shape and Shirley background correction. The spectra were calibrated using Ag 3*d* signal at 368.2 eV.

NMR Analysis: $^{13}C$ and $^{1}H$ Nuclear magnetic resonance (NMR) spectra were recorded on a 500 MHz ($^{1}H$ NMR resonance) spectrometer (Agilent, USA) at 25° C. with a 5-mm HX probe. The $^{13}C$ NMR spectra obtained at 125.715 MHz under broadband proton decoupling with a 90 degree pulse length of 9 μs and relaxation delay of 3 s. For 1H NMR at 499.909 MHZ, the 45 degree pulse length and the repetition delay were 3.8 μs and 5 s, respectively. 7Li NMR spectra were obtained at 194.298 MHz with the 90 degree pulse with 12 μs and repetition delay of 2 s. Both $^{1}H$ and $^{13}C$ chemical shifts were calibrated with tetramethylsilane (TMS) of 0 ppm as external standard.

Grazing Incidence X-Ray Diffraction (GIXRD) Analysis: To investigate the electrochemical selective leaching of Ln from the magnet electrodes employed for the potentiaostat measurements at different potentials for 2h, Grazing Incidence X-ray diffraction (GIXRD) was carried out. A fixed 5° incident angle was used to enable the penetration of 500 nm on the NdFeB magnet surface with 50-μm-diameter collimator. The GIXRD enabled the detection of smaller structural changes in surface layer compared to conventional XRD. Phase matching was carried out using JADE v.9.5.1 (Materials Data, Inc.) equipped with the 2019 PDF4+ database from ICDD (International Centre for Diffraction Data, Newtown Square, PA).

Example 1

Many permanent magnets comprise an intermetallic Nd—Fe—B alloy system. The magnet system is dominated by grains of $Nd_2Fe_{14}B$ intermetallic compound, where gadolinium (Gd), praseodymium (Pr) and possibly other REEs along with other transition metals are substituted in the lattice of the $Nd_2Fe_{14}B$ phase, leading to heterogeneous chemical distributions (Tang et al., *J of Appl. Physics* 1988, 64:5516-5518). Beyond this compositional variance, Nd-rich phases with different crystal structures have also been identified with Nd concentrations ranging from 70 to 90% rendering additional structural complexities (Wang et al., *J of Magnetism and Magnetic Materials* 2005, 285:177-182; Mo et al., *Scripta* Materialia 2008, 59:179-182). Additionally, end-of-use (EoU) Nd—Fe—B magnets are known to have morphological diversity arising from grains, oxidized grain boundary regions and protective coatings encompassing multiple chemical and structural phases (Lu et al., *Materials* 2019, 12 (23): 3881).

Figure 2A:
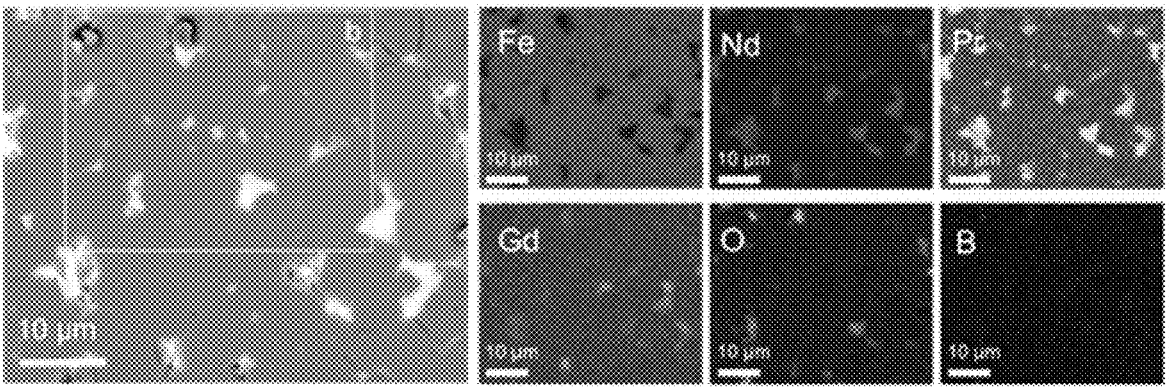
FIGS. 2A-2C show scanning electron microscopy and elemental mapping (FIGS. 2A, 2B) of a commercial Nd—Fe—B product, and energy dispersive x-ray (EDX) analysis of a polished surface of the Nd—Fe—B product (FIG. 2C).
Figure 2B:
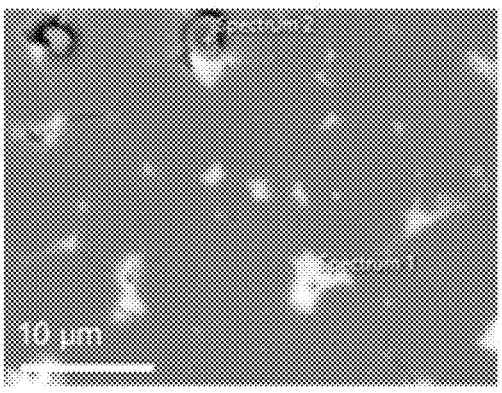
Figure 2C:
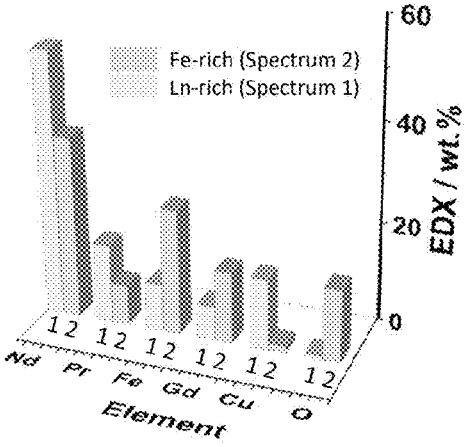

To determine the structural and chemical complexity of a commercial Nd—Fe—B product, SEM based microscopic and compositional analysis were performed on a polished magnet as shown in FIGS. 2A-2C. The region of elemental mapping is shown in the box of FIG. 2A. In FIG. 2B, the spots of Spectrum 1 and Spectrum 2 for EDX analysis are marked. The overall lanthanide (LN) composition was over 32 wt %, including ~20 wt % Nd, ~7.4 wt % Gd and ~4.6 wt % Pr, mostly concentrated as Ln-rich phases embedded across common iron rich $Nd_2Fe_{14}B$ phase separated by clear grain boundaries, as shown in FIGS. 2B and 2C. Overall, the Nd—Fe—B magnet was embedded with structural and compositional heterogeneity ranging from atomic scale to mesoscale.

Example 2

Cyclic voltammetry (CV) was performed over a wide potential range (−3.25 V to 1.0 V) for ten consecutive cycles at 20 mV/s scan rate using 0.1 M LiCl in DMF on a Pt electrode with a Nd—Fe—B magnet as the counter electrode and $Ag/Ag_2O$ as the reference electrode. The Nd—Fe—B magnet was suspended in the cell using a Pt wire. The first cycle CV representing the initial electroleaching process (FIG. 3) clearly established the oxidative stripping reactions of $Ln^{3+}$ such as $Nd^{3+}$, $Gd^{3+}$ and $Pr^{3+}$ at around −2.25 V followed by iron, a primary constituent of the magnet, at around −0.7 V. The reduction reactions of $Nd^{3+}$ and $Nd^{2+}$ were observed in all ten cycles at −2.9 V and −2.58 V, respectively. The reduction reaction of borate was observed in the first cycle at −1.11 V. The reductions of aluminum and nickel were also observed at −1.66 V and −0.72 V, respectively. Despite purchasing a commercially produced uncoated magnet, the nickel and aluminum observed in the experiments suggest there may have been a protective coating on the magnet to avoid surface oxidization. FIGS. 4A-4D are digital photographs (FIGS. 4A, 4C) and SEM images (FIGS. 4B, 4D) of the Pt electrode before (FIGS. 4A, 4B) and after (FIGS. 4C, 4D) the CV cycles. The after images clearly show electrodeposited material on the Pt surface. The boundary between the nascent (upper shiny) and electrodeposited (mat) regions of the Pt electrode was clearly distinguishable visually as shown in FIGS. 4A and 4C, respectively. SEM images of the two regions also showed rough surface with lots of deposits post-CV (FIG. 4D) cycling compared to pristine Pt electrode pre-CV (FIG. 4B).

Figure 5A:
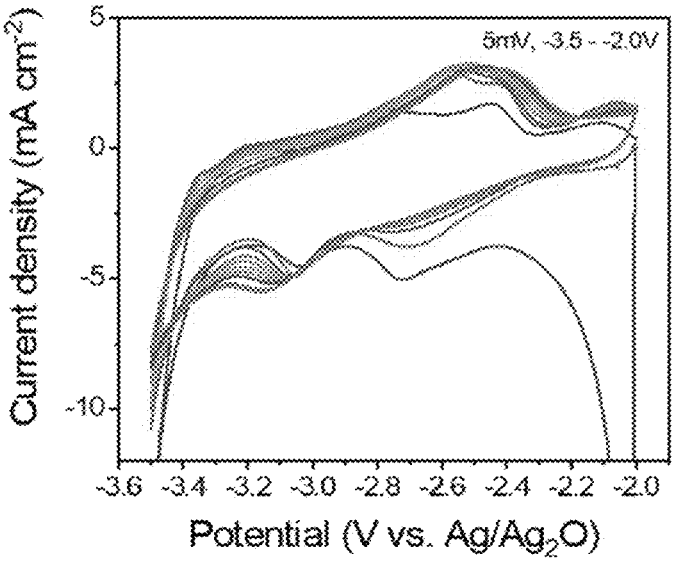
FIGS. 5A-5C are cyclic voltammograms of a Nd—Fe—B magnet versus Pt counter electrode performed at a scan rate of 5 mV $s^{-1}$ for 10 cycles over different potential ranges: −3.5 V to 2.0 V (FIG. 5A), −3.25 V to −2.25 V (FIG. 5B) and −3.15 V to −2.5 V (FIG. 5C) with 0.1 M $LiClO_4$ in DMF electrolyte.
Figure 5B:
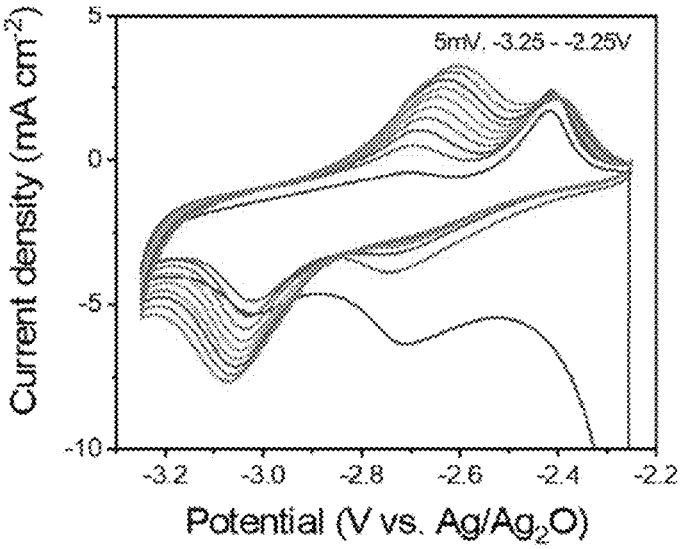
Figure 5C:
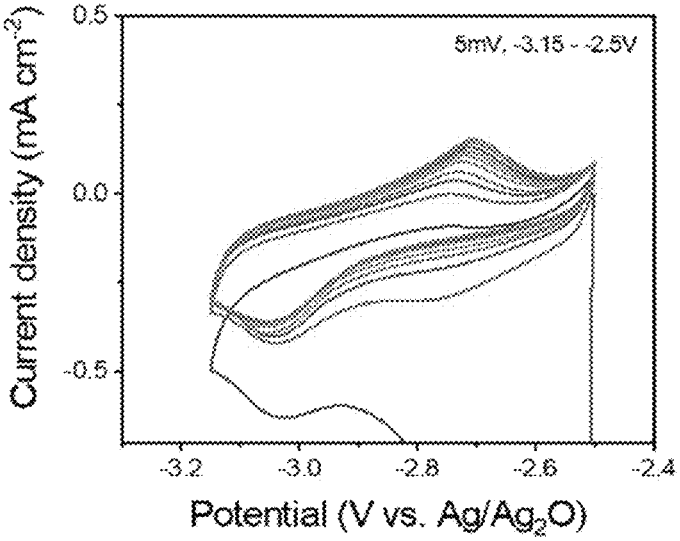

Selective Nd deposition was evaluated by varying the reduction potential ranges. The cyclic voltammograms obtained under different potential ranges in FIGS. 5A-5C showed that the narrower potential range (FIG. 5C) only exhibited the two typical reduction peaks corresponding to $Nd^{2+}$ and $Nd^{3+}$ without reduction peaks for other metal ions and undesired formation of organic components from electrolyte decomposition.

Figure 6A:
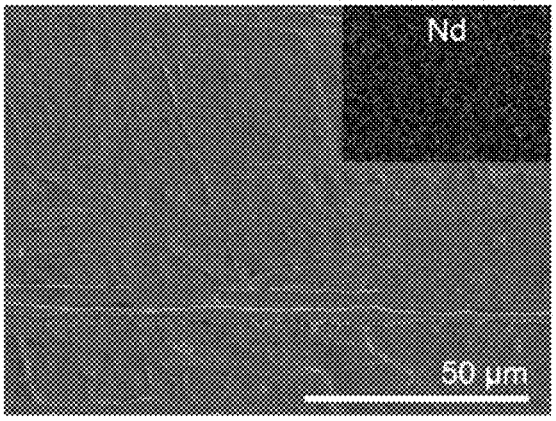
FIGS. 6A-6E show SEM images of a Pt electrode after 10 cycles of CV in a potential range of −3.15 V to −2.5 V (FIGS. 6A, 6B), wide scan XPS spectra of pristine Pt and Pt after electrodeposition (Pt-ED) electrodes (FIG. 6C), and XPS depth profile analysis in the Nd 4d region (FIGS. 6D, 6E).
Figure 6B:
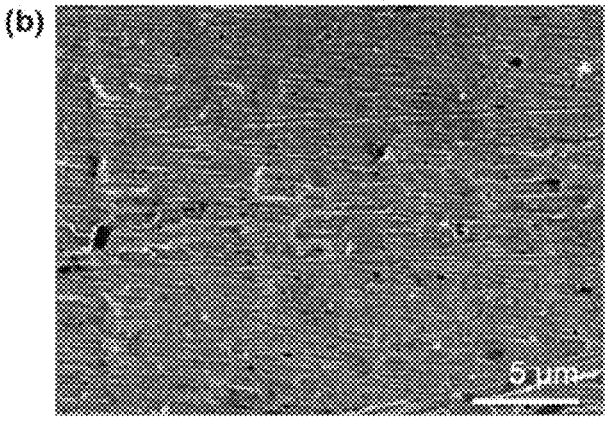
Figure 6C:
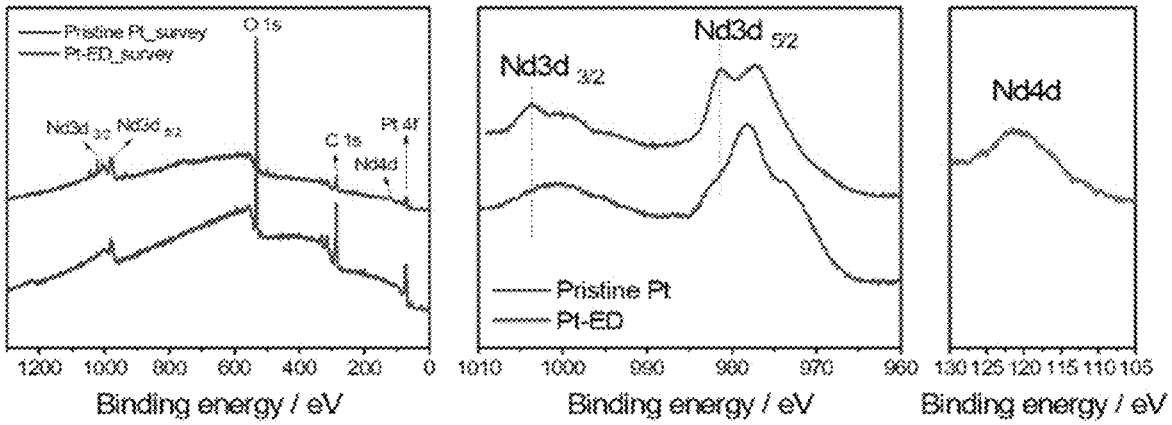
Figure 6D:
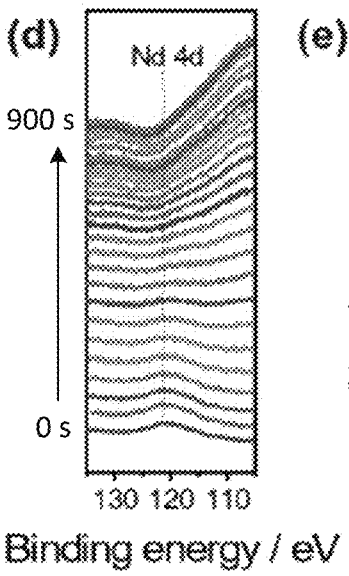
Figure 6E:
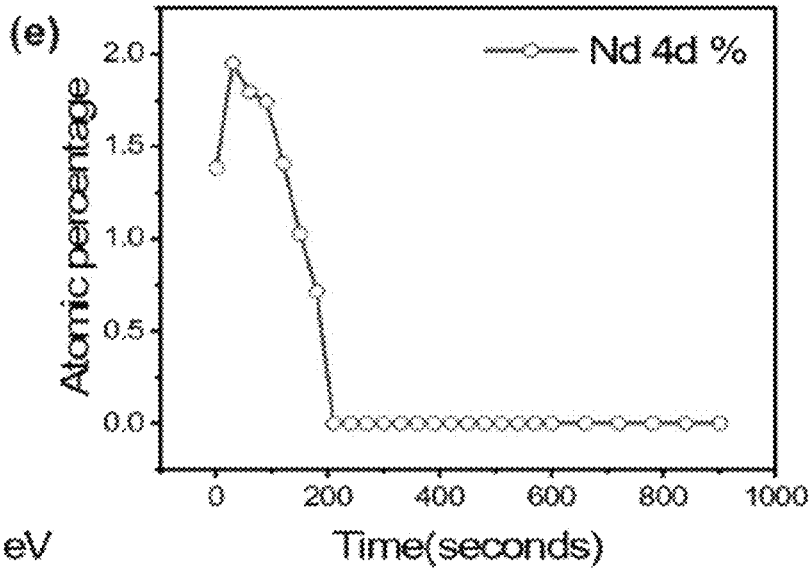
Figure 7A:
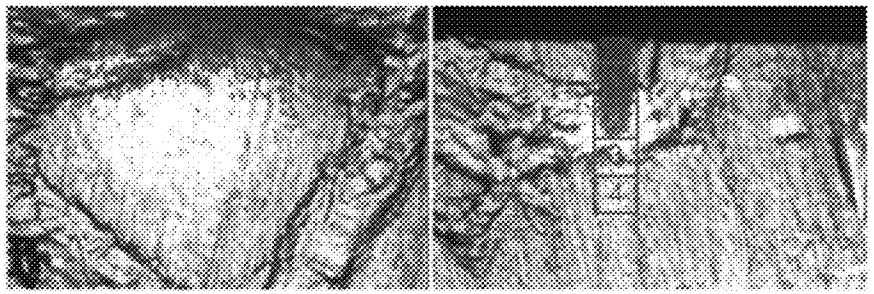
FIGS. 7A-7D are AFM images with a scan size of 200 μm×200 μm (FIG. 7A) and three-dimensional depth profiles for three different subregions of Nd electrodeposited onto the Pt electrode (FIGS. 7B-7D).
Figure 7B:
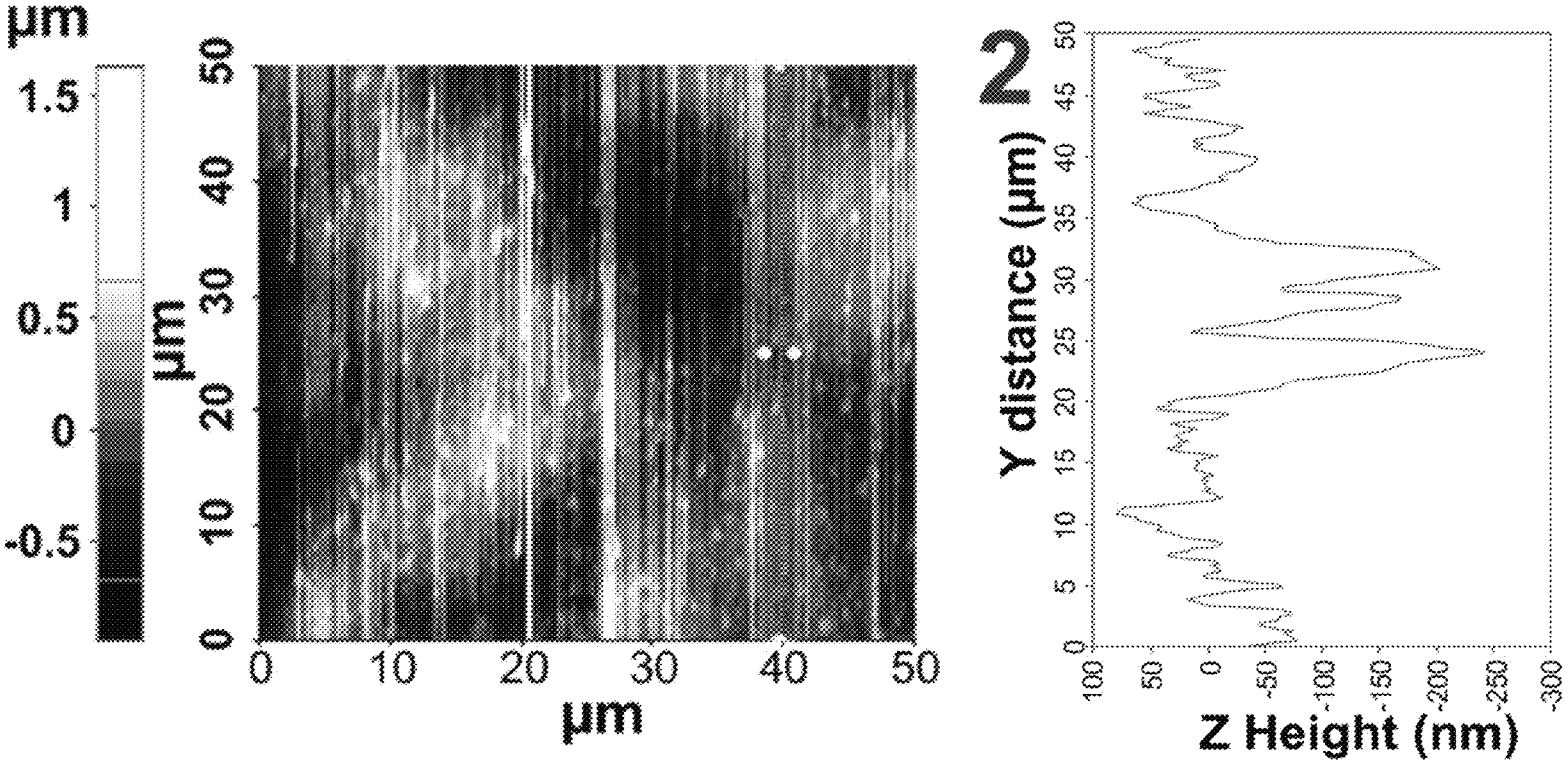
Figure 7C:
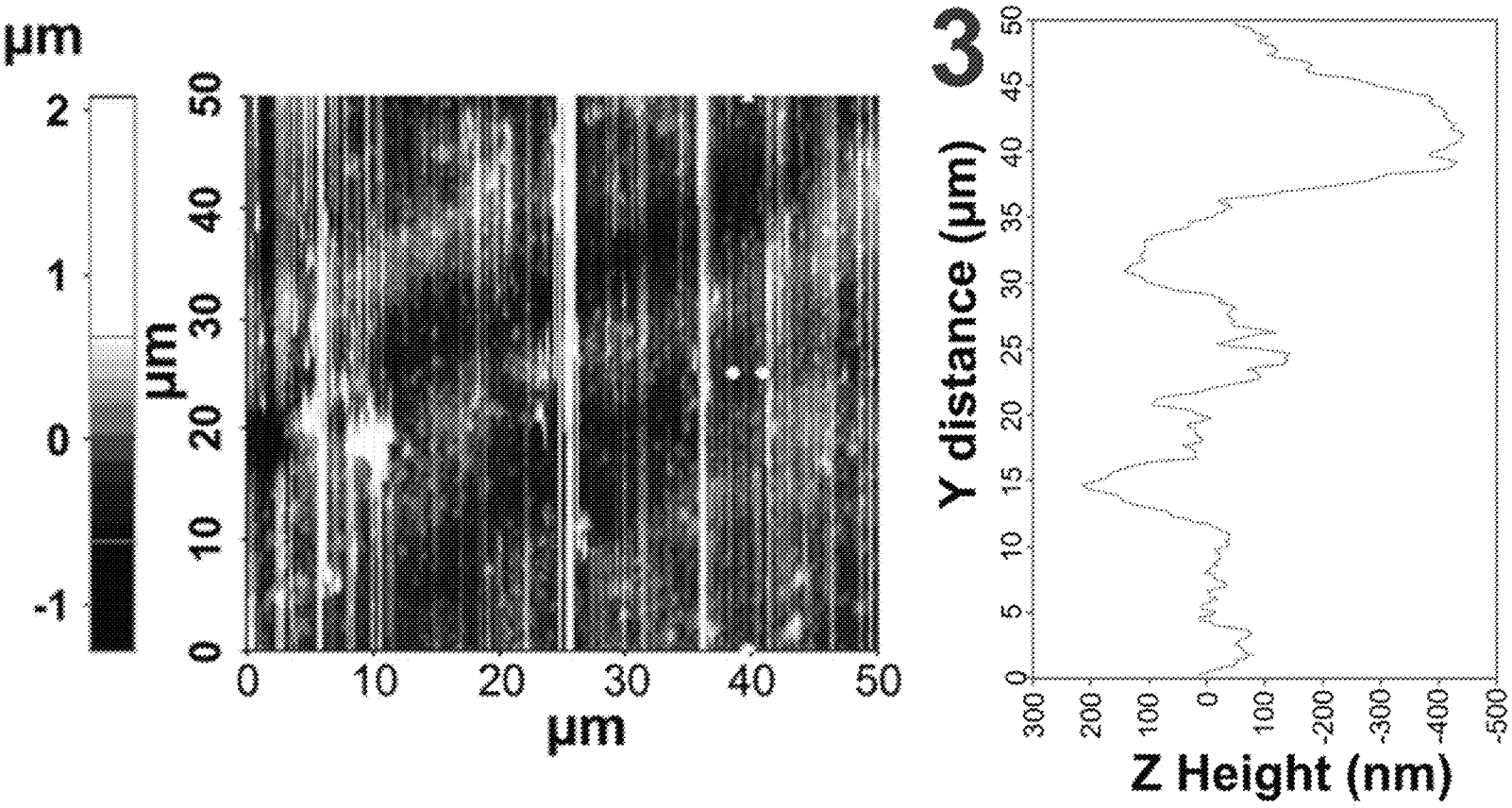
Figure 7D:
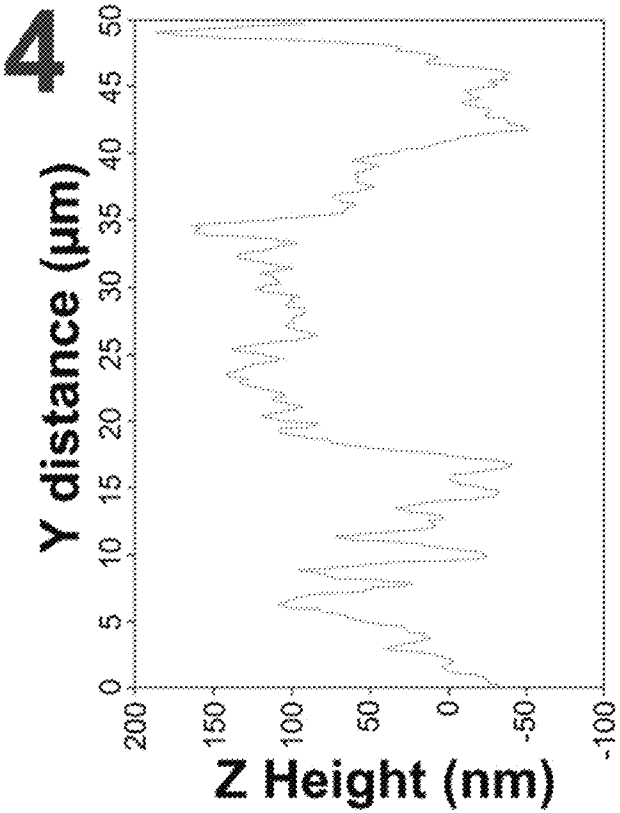
Figure 7D:
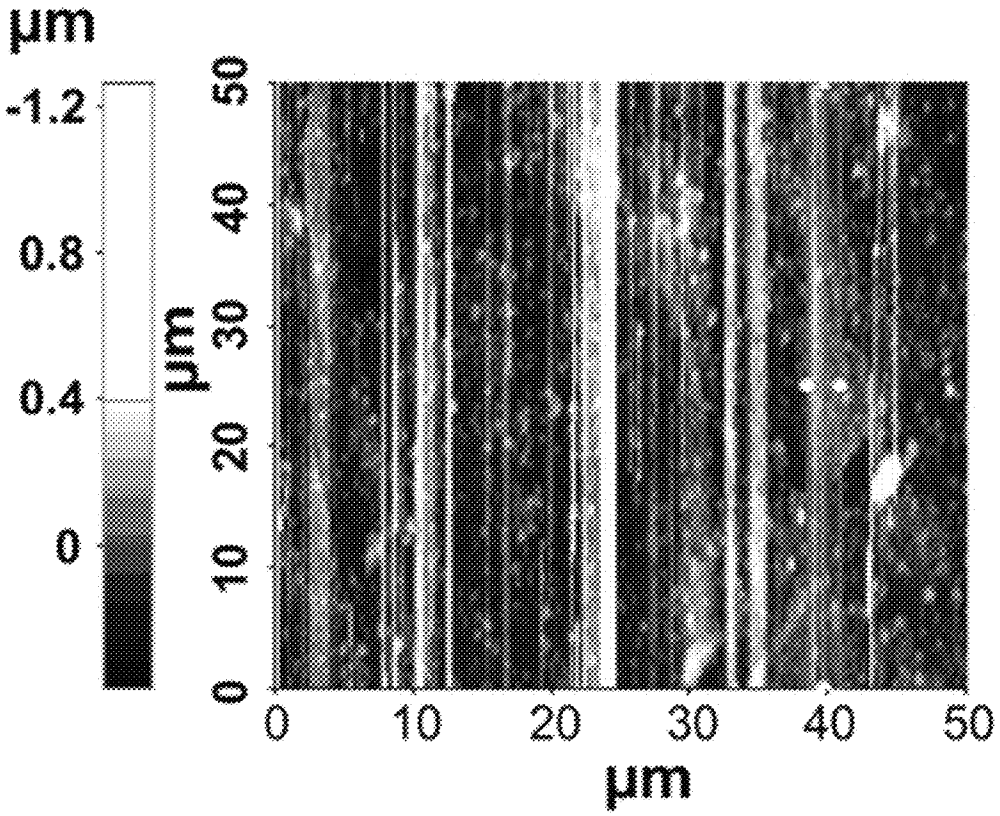

The Pt electrodes used in the narrowest potential range, −3.15 V to −2.5 V, were further evaluated using SEM, EDX, and XPS. FIGS. 6A and 6B show SEM images with different magnifications, displaying the rough deposit layer surface after 10 cycles of CV at a scan rate of 5 mV $s^{-1}$. The EDX map image (inset, FIG. 6A) indicates that Nd was uniformly detected throughout the sample. Based on wide scan XPS spectra of the pristine Pt and Pt after electrodeposition (Pt-ED) samples, it is notable that $Nd^3d_{3/2}$, $Nd^3d_{5/2}$, and $Nd^4d$ spectra appeared at 1003.9 eV, 981.4 eV, and 121 eV in the Pt-ED sample due to the electrodeposited Nd, while the pristine Pt had no Nd signal as shown in FIG. 6C. XPS spectra of the Pt-ED sample also showed that other metals were not detectable on the deposited layer. The O1s and C1s spectra were detected on both samples at 531.9 eV and 289.9 eV, indicating that the commercial Pt electrode intrinsically had some oxygen-containing impurities on its surface. The evaluated the depth of the deposited Nd layer, the $Nd^4d$ region was scanned every 30 seconds to 900 seconds, as shown in FIGS. 6D and 6E. Based on the depth profile, the electrodeposited Nd film was about 2 at % and 23 nm thick. Atomic force microscopy (AFM) imaging also demonstrated the thickness of the Nd layer and its uniformity on the Pt electrode surface (FIGS. 7A-7D).

Although the CV confirmed the applied potential as a control parameter for selectively electroleaching of REEs from the Nd—Fe—B magnet under the LiCl/DMF electrolyte conditions, it is desirable to establish continuous state electrodeposition at the Pt counter electrode. The reductive platting potentials of REEs along with redox potentials of other chemical components of Nd—Fe—B magnet such as corrosion resistant layers and impurities at the Pt counter electrode are shown in Table 1.

TABLE 1

| $E_{Ag/Ag2O}$ | $E°_{(calc)}$ | E° | Reduction reaction |
|---|---|---|---|
| −2.9 V | −2.56 V | −2.7 V | $Nd^{3+} + e^- \leftrightarrow Nd^{2+}$ |
| −2.58 V | −2.24 V | −2.323 V | $Nd^{3+} + 3e^- \leftrightarrow Nd(s)$ |
| | | −2.1 V | $Nd^{2+} + 2e^- \leftrightarrow Nd(s)$ |
| −1.61 V; 2.03 V to 1.3 V | −1.27 V; −1.68 V to −0.96 V | −1.66 V | $Al^{3+} + 3e^- \leftrightarrow Al(s)$ |
| −1.11 V | −0.77 V | −0.89 V | $B(OH)_3 + 3H^+ + 3e^- \leftrightarrow B(s) + 3H_2O(l)$ |
| −0.95 V | −0.61 V | −0.72 V | $Ni(OH)_2(s) + 2e^- \leftrightarrow Ni(s) + 2OH^-$ |
| −0.72 V | −0.38 V | −0.44 V | $Fe^{2+} + 2e^- \leftrightarrow Fe(s)$ |
| 0.74 V | 1.08 V | 1.19 V | $Pt^{2+} + 2e^- \leftrightarrow Pt(s)$ |

Figure 8:
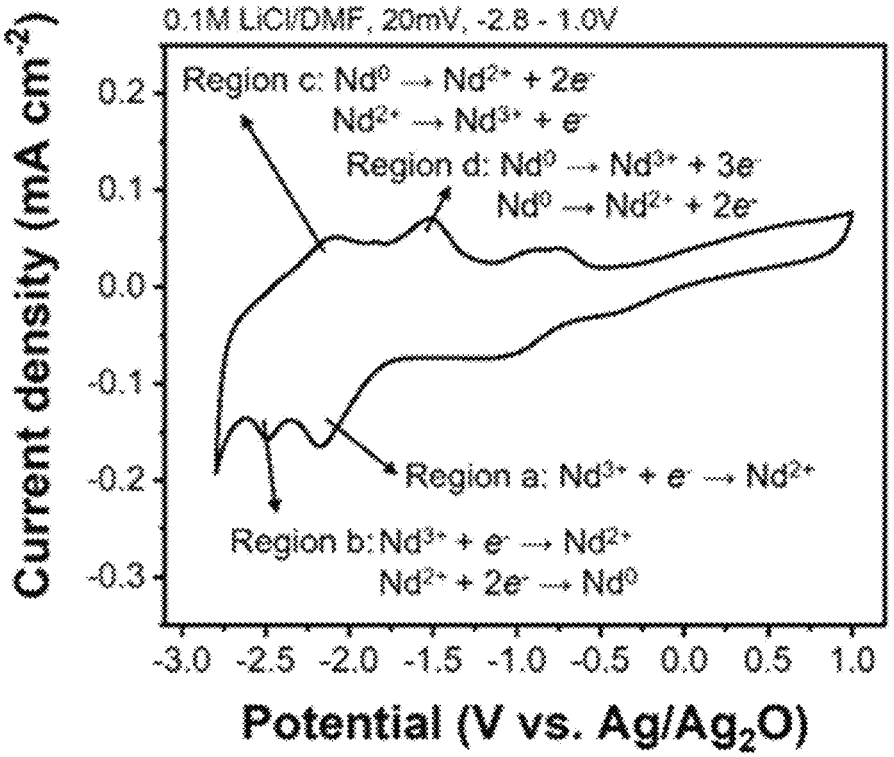
FIG. 8 shows CV performed at a scan rate of 20 mV $s^{-1}$ in the potential range −2.8V-1.0V vs. $Ag/Ag_2O$.

The CV measurement shows that the reductive potentials of $Nd^{3+}$ and $Nd^{2+}$ are around at −2.9 V and −2.58 V, respectively (FIG. 8) in the DMF-based electrolyte. The reductive potential scan shows multiple regions indicative of $Nd^{3+}$ reduction to $Nd^{2+}$ (region a) followed by $Nd^{3+}$ and $Nd^{2+}$ reduction to $Nd^{2+}$ and $Nd^0$ respectively (region b). Oxidative potential scan shows $Nd^0$ and $Nd^{2+}$ oxidations (region c) followed by and $Nd^0$ oxidation to $Nd^{3+}$ and $Nd^{2+}$ (region d). Other lanthanides, such as Pr and Gd likely would overlap these redox potentials, as shown by the values in Table 1. The reduction reactions of borate and iron were observed at −1.11 V and at −0.72 V respectively. Relatively smaller reduction peaks representing aluminum and nickel were also observed at −1.66 V and −0.72 V respectively, indicating a corrosion resistance layer in commercial magnets. This clear separation of reduction potentials among common constituents of commercial Nd—Fe—B based magnet further validates the one-pot electrochemical separation and electrodeposition of Ln elements. Advantageously, the voltage is selected to ensure the oxidative dissolution potential is optimal for selective and continuous Ln electrodeposition and within the electrochemical stability window of the electrolyte system.

Figure 9:
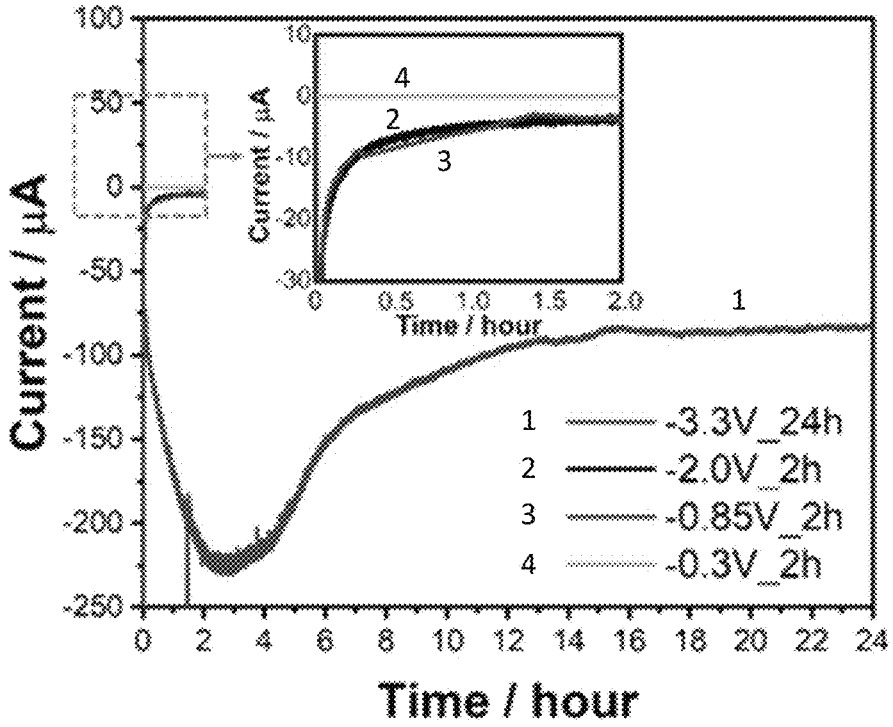
FIG. 9 shows the amperometric current response of the Pt working electrode as a function of the applied potential for 2 hours (inset), and for 24 hours at, −0.3 V, −0.85 V, −2.0 V, or −3.3 V.

The CV measurement revealed the range of oxidative and reduction potentials for Ln-elements embedded within the chemical heterogeneity of Nd—Fe—B magnet. To establish a single oxidative dissolution potential with higher selectivity and coulombic efficiency, constant potential amperometry was performed across various oxidative potentials (from −0.3V to −3.3V). The amperometry analysis, shown in FIG. 9, revealed that a −3.3V potential provided a higher current density implying continuous oxidative dissolution of Nd—Fe—B magnet. At −3.3V, the dissolution current reached a maximum of about 230 uA after ~2 hours and then slowly reduced and established a stable 85 μA current after 14 hours. This current evolution revealed that the rate of dissolution and deposition not only depends on the applied potential but could also depend on electrolyte stability and/or oxidative reaction front propagation mechanisms defined by multiphase grain boundary regimes of Nd—Fe—B system (Liu et al., *Materials & Design* 2021, 209: 110004).

Example 3

Figure 10A:
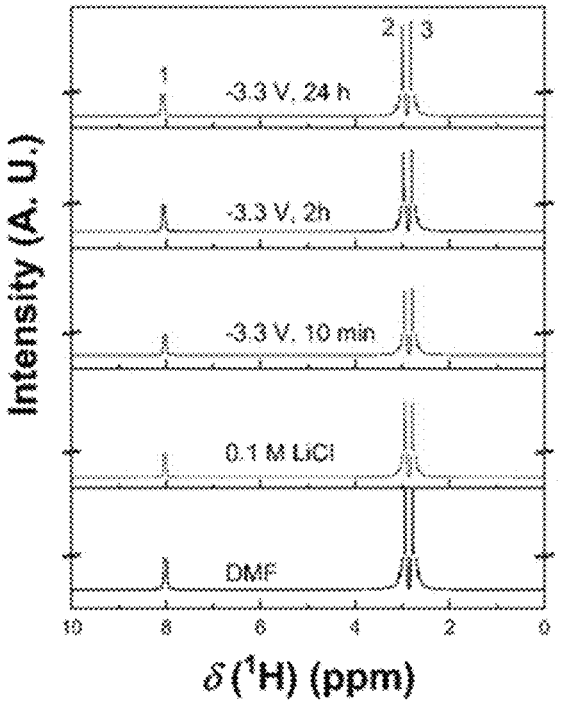
FIGS. 10A-10C show time-dependent (10 minutes to 24 hours) nuclear magnetic resonance (NMR) spectra $^1H$ (FIG. 10A), $^{13}C$ (FIG. 10B), and $^7Li$ (FIG. 10C) of the 0.1 M LiCl/DMF electrolyte after the constant potential amperometry at −3.3 V.
Figure 10B:
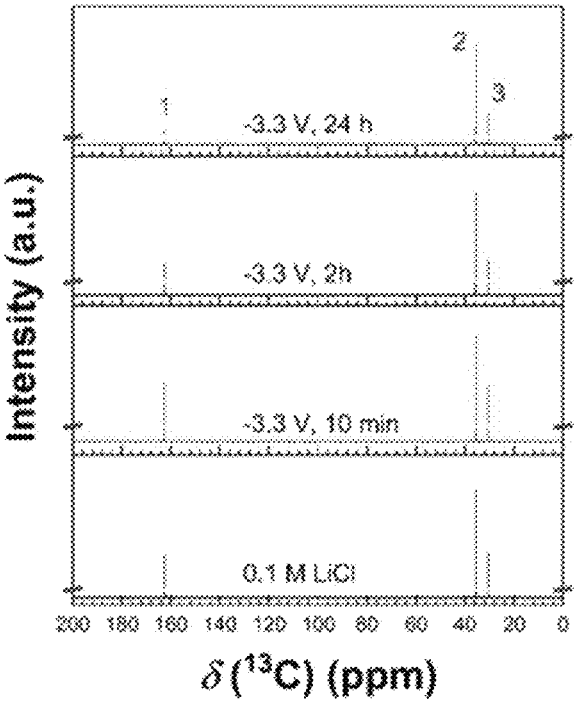
Figure 10C:
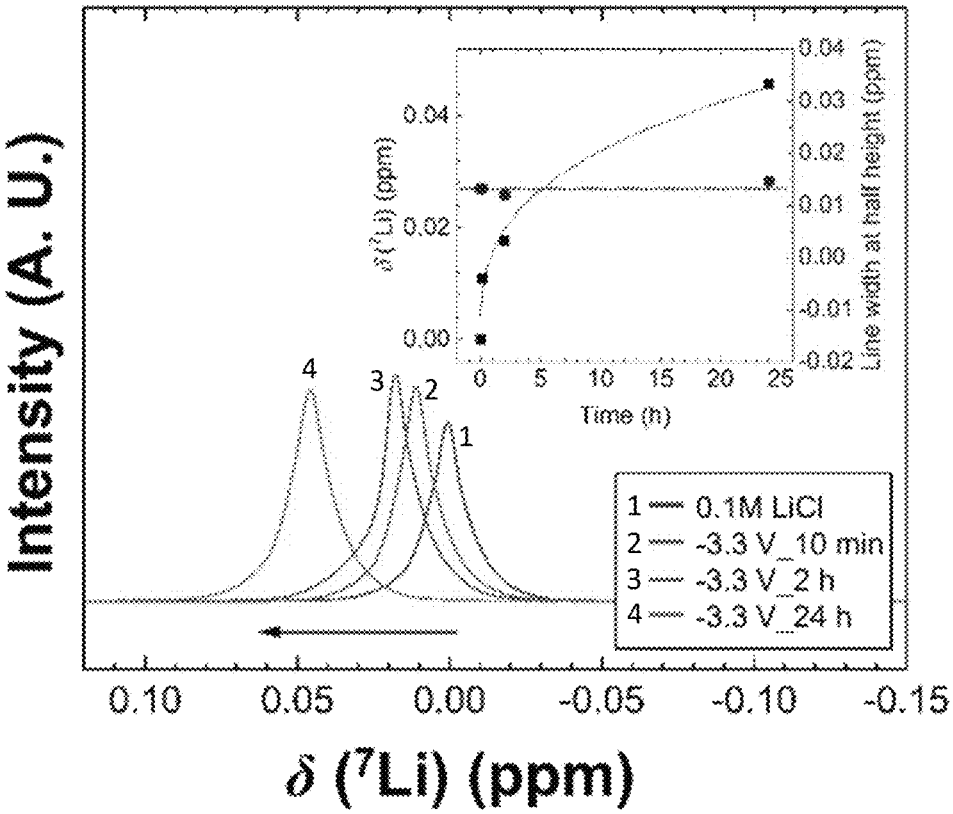

To evaluate the stability of LiCl/DMF electrolyte, nuclear magnetic resonance spectroscopy (NMR) spectroscopy was used (FIGS. 10A-10C). The absence of new peaks, after 24 hours constant potential amperometry condition, suggested that the LiCl/DMF solution is relatively stable for recovery of REEs. In addition, all NMR spectra ($^{1}H$, $^{13}C$ and 7Li) showed a gradual shift to higher frequency (larger chemical shift) due to the increase of the concentration of dissolving paramagnetic Ln ions during the constant potential amperometry. For example, the chemical shift differences of $^{1}H$ and 7Li resonances between the samples before taking the amperometry (0.1 M LiCl) and after 24 h of amperometry (−3.3V, 24 h) were 22.35 and 8.86 Hz, respectively, suggesting most dissolved Nd ions were solvated by DMF solvent molecules and minimally affected the existing lithium solvation structure and subsequently its diffusion process, which dictates the overall ionic conductivity of the electrolyte. This can also be confirmed from the inset of FIG. 10C, which showed a minimal change in the line width (FWHH) while the chemical shifts of the 7Li NMR spectra shifted to the higher frequency (more paramagnetic) as the time increased for the constant potential amperometry. The 1H and $^{13}C$ NMR analyses of the electrolyte after 24 hours dissolution at −3.3V showed no detectable decomposition products indicating that the DMF based electrolytes are relatively stable for the constant potential amperometry conditions to concurrently dissolve and deposit the Ln ions.

Previous corrosion and leaching studies under aqueous conditions noted similar phenomena, where the dealloying reaction front propagates through selective grain boundaries involving Nd-rich regions, while skipping some grains altogether (Makarova et al., Hydrometallurgy 2020, 192: 105264; Kitagawa et al., *Scientific Reports* 2017, 7:8039; Önal et al., J of Sustainable Metallurgy 2015, 1:199-215). Such selective dissolution pathways across grain boundary are dictated by intra-grain solid-phase diffusion limitations, which likely manifests as a gradual drop in dissolution current after 2 hours (FIG. 6).

Example 4

Figure 11A:
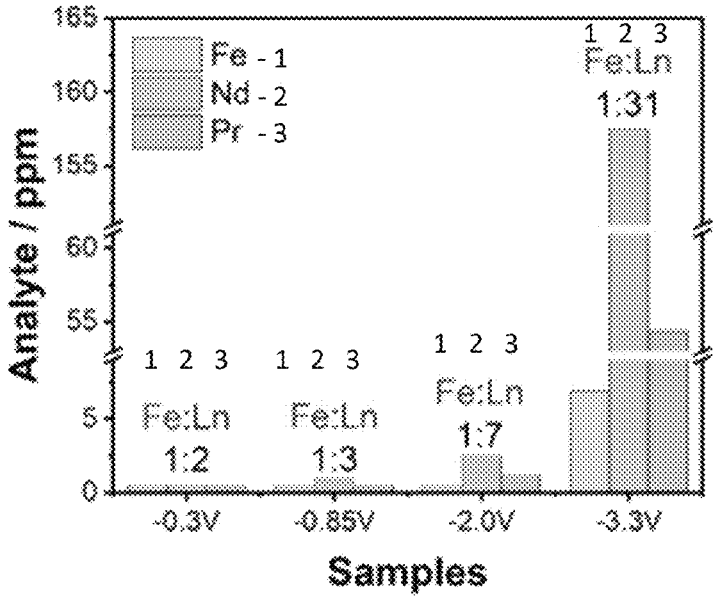
FIGS. 11A and 11B show inductively coupled plasma optical emission spectroscopy analysis of Nd, Pr, and Fe concentrations in 0.1 M LiCl/DMF electrolytes (FIG. 11A) and corresponding SEM images of the magnet electrodes (FIG. 11B) after amperometry dissolution performed under different potentials for 2 hours.
Figure 11B:
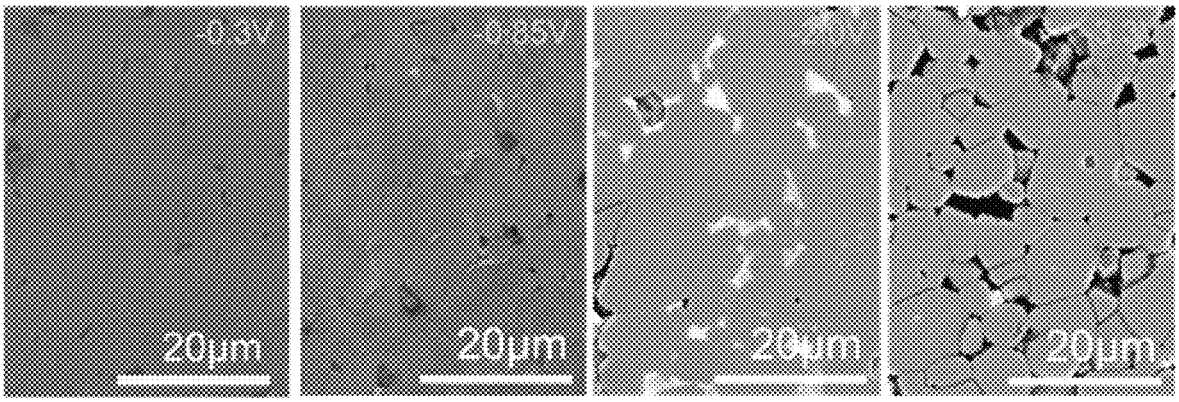

To enable a continuous dissolution process, the dissolving element, dissolution front and associated grain boundary regimes of Nd—Fe—B magnets were evaluated. To identify the dissolving element, inductively coupled plasma (ICP) based compositional analysis of electrolytes were performed after amperometric dissolution at −0.3 V, −0.85 V, −2.0 V, and −3.3 V (FIG. 11A). The Ln elements (primarily Nd and Pr) were the dominant solute with a nearly 31:1 compositional ratio with Fe after 24 hours of applied potential. SEM images (FIG. 11B) indicate that the Ln rich phases were clearly leached out at −3.3 V while other potentials did not work, demonstrating selective leaching.

Figure 12:
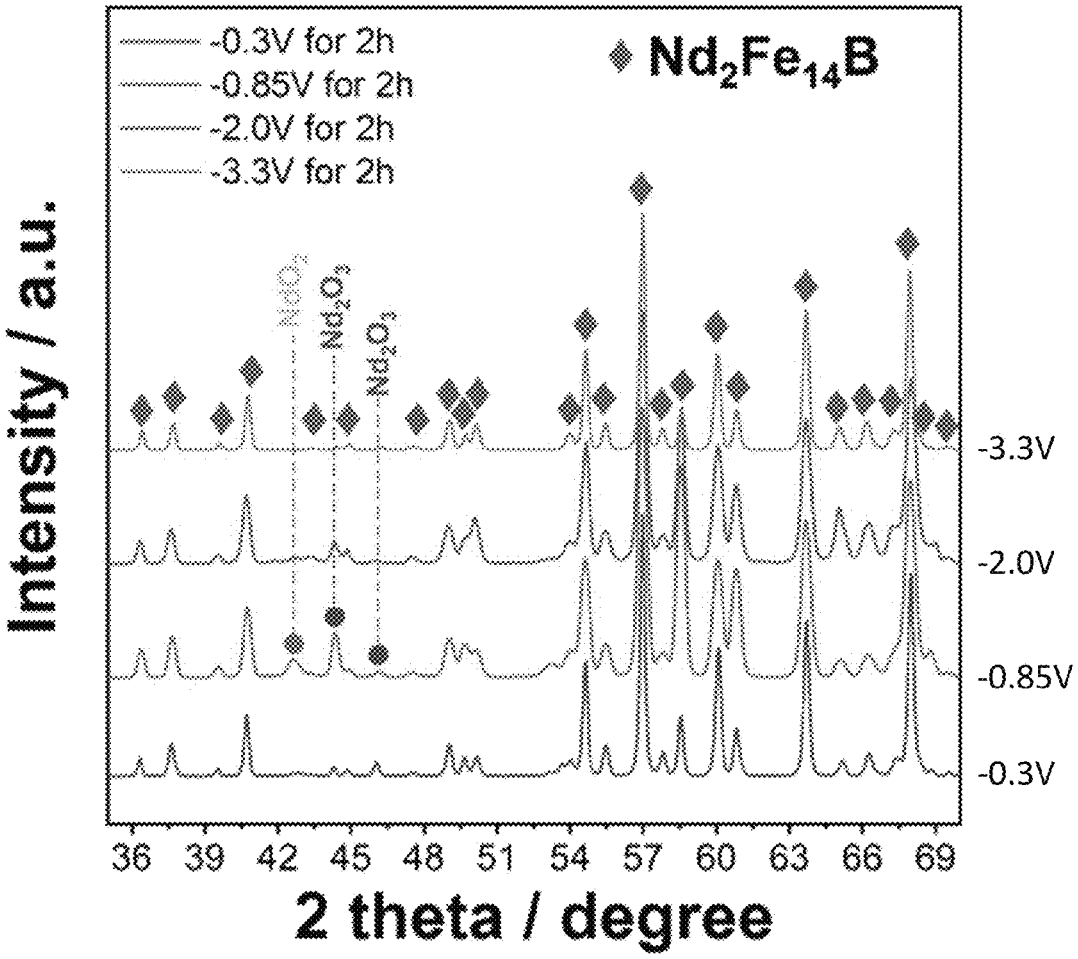
FIG. 12 shows grazing incidence X-ray diffraction (GIXRD) patterns of the polished magnet electrodes after amperometric dissolution of Ln in the 0.1M LiCl/DMF electrolyte measured with the Pt counter electrode and Ag pseudo reference electrode at different potentials for 2 hours.

The presence of iron in the electrolyte suggests iron rich grains undergoing oxidative dissolution and/or becoming detached from Ln-rich grains due to dealloying of dominant alloy constituents. However, theoretically (vide infra) the oxidative potential of iron dissolution should be higher than 0.1 V (i.e., $Fe(s) \rightarrow Fe^{2+}+3e^{-}$ vs $Ag/Ag_2O$) and hence dissolution from the iron-rich $Nd_2Fe_{14}B$ phase is not feasible at applied potential of −3.3V. Without wishing to be bound by a particular theory of operation, it is likely that dissolution-induced dealloying leads to leaching of some residual iron from Ln-rich grains and grain boundary regimes. If the iron-rich $Nd_2Fe_{14}B$ phase was not participating in the selective dissolution process under applied potential, it would be expected to maintain its crystalline and morphological structure. Similarly, if the Ln-rich phase were selectively dissolving, it would be expected to significantly alter the microstructural grain arrangements of Nd—Fe—B magnets. To evaluate the structural and chemical evolutions on Nd—Fe—B magnet upon selective oxidative dissolution, grazing incidence X-ray diffraction (GIXRD) and SEM analysis were performed. The GIXRD pattern (FIG. 12) revealed no significant changes within the iron rich lattice of $Nd_2Fe_{14}B$ phase, indicating the dissolution was most likely from Ln-rich phases distributed across the Nd—Fe—B magnet. It is known that Ln-rich grain boundaries are likely to be enveloped with oxide layers, such as $Nd_2O_3$ and $NdO_2$, which could passivate against oxidative dissolution. Nevertheless, the major GIXRD peaks at 44° and 46° corresponding to $Nd^2O_3$ and at 43° corresponding to $NdO_2$ disappear when the applied potential becomes more negative (−3.3V), demonstrating that electrochemical stimuli can initiate and sustain selective Ln oxidation despite chemical heterogeneity of Nd—Fe—B magnets. SEM analysis revealed selective dissolution from Ln-rich phases with rate of dissolution depending on the applied potential and duration. For example, after 2 hours at −3.3 V, the preferential dissolution of Ln-rich grains resulted in voids and discontinuous distribution of the $Nd_2Fe_{14}B$ phase (FIG. 9B). This finding implies that, after 2 hours of electrolytic dissolution, the lack of continuous Ln-rich grains at the surface limits the Ln diffusion pathways and subsequently suppresses the dissolution rate which manifests as a drop in current. The results suggest that oxidative dissolution is solid-phase diffusion dependent and primarily involves the Ln-rich regions leaving the $Nd_2Fe_{14}B$ phase mostly intact, likely due to significantly shifted oxidation potentials of iron-rich grains. Nevertheless, considering that the Ln-composition is primarily concentrated (~80% of total Ln composition in the magnet) in Ln-rich regions (as shown in FIGS. 2A-2C), the lack of iron-rich $Nd_2Fe_{14}B$ phase involvement in electrochemical dissolution does not impede the overall extraction efficiency.

Figure 13A:
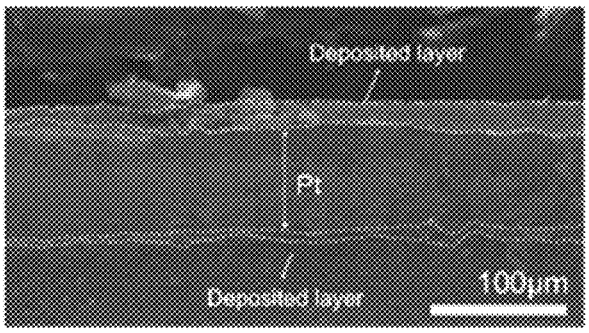
FIGS. 13A-13C show a cross-sectional SEM image of a Pt electrode with deposited layers on both sides by the amperometric dissolution and electrodeposition of Ln in 0.1M LiCl/DMF electrolyte at −3.3V (FIG. 13A), an SEM image of the Pt electrode showing surface morphology likely produced by clustered nucleation of REEs during the deposition process (FIG. 13B), and cross-sectional chemical element maps from EDX analysis (FIG. 13C).
Figure 13B:
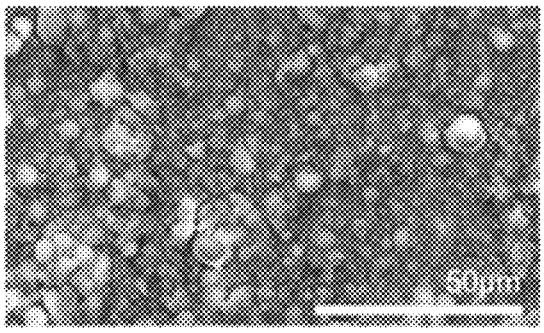
Figure 13C:
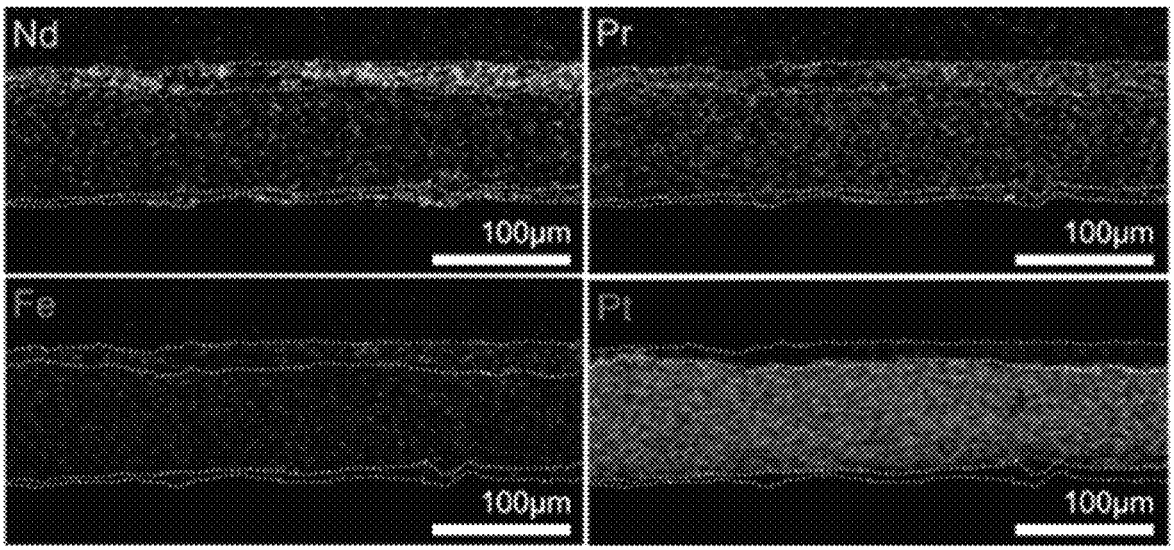
Figures 14A, 14B:
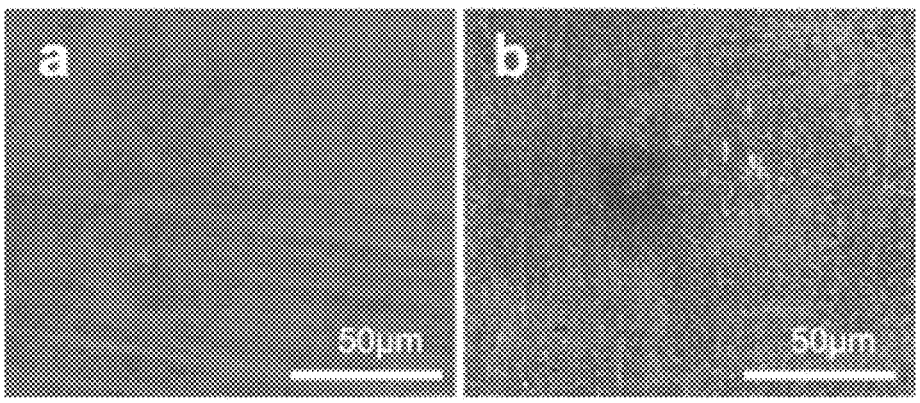
FIGS. 14A-14D are SEM images of the Pt electrode surfaces after electrodeposition in 0.1 M LiCl/DMF electrolytes by potentiostatic measurement at −3.3 V for 0 minutes (FIG. 14A), 10 minutes (FIG. 14B), 2 hours (FIG. 14C), and 24 hours (FIG. 14D).
Figures 14C, 14D:
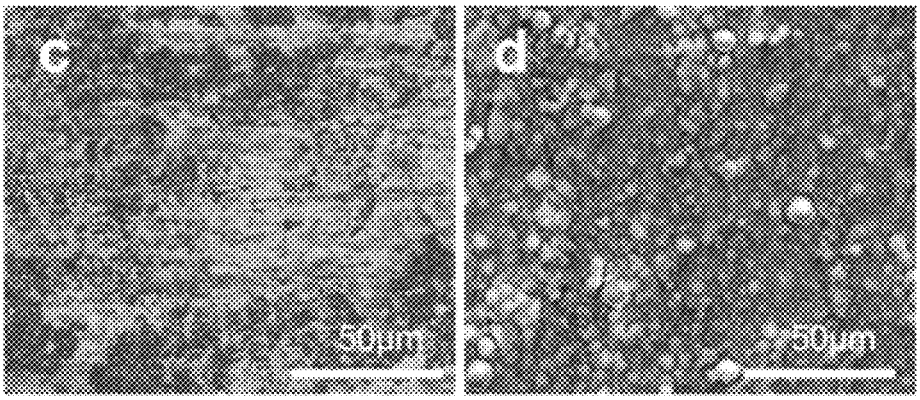

The dissolved Ln-elements under amperometric conditions underwent a reduction reaction and were electrodeposited as a metallic alloy at the Pt cathode. The Pt electrode was investigated by SEM and EDX as shown in FIGS. 13A-13C. Clearly distinguishable layers on both sides of Pt electrode confirmed a concurrent metal deposition process under amperometric dissolution conditions. Based on SEM-EDX data (Table 2), it was verified that the deposited layer predominantly contained Nd and Pr elements, with about a 3:1 wt % Nd: Pr ratio. Interestingly, while the Fe was detected, Gd was not detected in the deposits. Without wishing to be bound by a particular theory of operation, it is likely that Gd primarily is distributed in Fe-rich regions, rather than Ln-rich regions. Thus, the Gd is more likely to be alloyed with Fe and other metals, which are not leached out in the selective leaching process disclosed herein. The absence of Gd agrees with ICP electrolyte analysis, whereas the Fe could be surface adsorption and/or metal deposition from co-leached $Fe^{3+}$ species present in electrolyte.

TABLE 2

| | Pt electrode at −3.3 V for 2 hours | | | | | | | | |
|---|---|---|---|---|---|---|---|---|---|
| | Pt | C | O | Nd | Al | Pr | CI | Fe | Ag |
| Wt. % | 44.7 | 32.0 | 16.9 | 1.8 | 1.2 | 0.7 | 0.5 | 0.5 | 0.3 |

A closer look at the SEM images (FIG. 13B and FIGS. 14A-14D) also reveals clustered particles ranging in size from submicron to a few microns across the Pt surface. Both the nucleation kinetics and morphology of these clusters will depend on interfacial reactivity in addition to surface adsorption and diffusion of Ln elements (Radisic et al., *Nano Letters* 2006, 6:238-242). In particular, parasitic reactivity between depositing metallic lanthanides and electrolyte molecules can create passivating layers (such as an oxide layer) which can limit further metal deposition. Any such parasitic reactivity would primarily depend on the electrochemical stability of the solvent molecules.

Figure 15A:
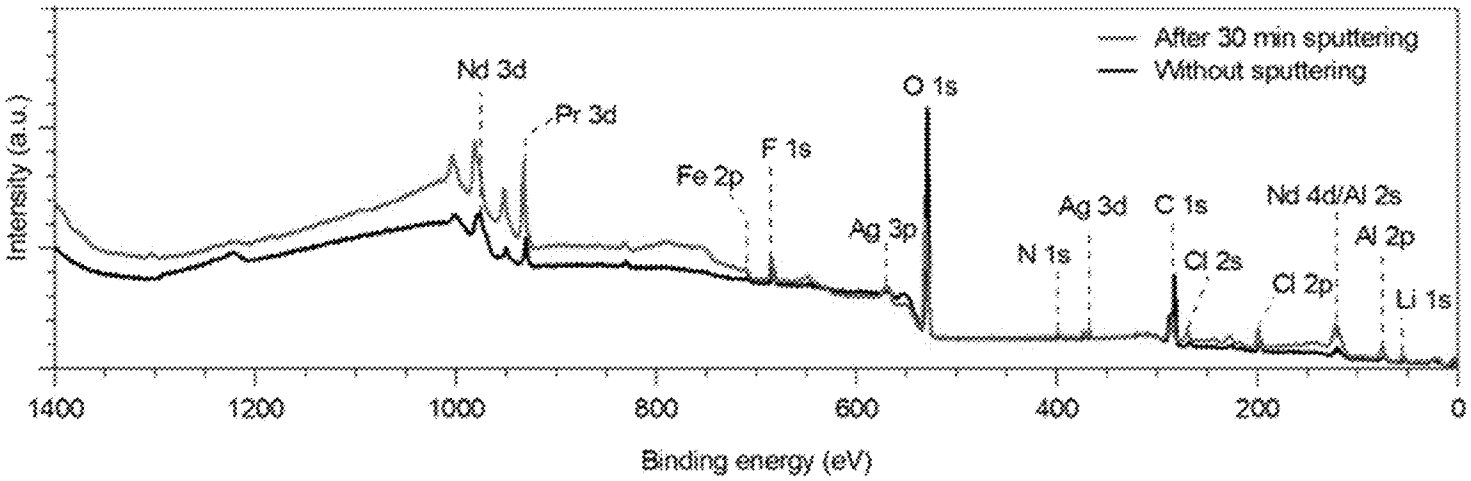
FIGS. 15A-15F show XPS analysis results. XPS survey spectra were collected on the Pt surface after the amperometric dissolution of Ln from the Nd—Fe—B magnet electrode and concurrent reduction at −3.3V for 24 hours (FIG. 15A). The core-level spectra of Nd 3d (FIG. 15B) and Pr $3d_{5/2}$ (FIG. 15C) before and after Ar sputtering revealing chemical state distribution across plating depth. The XPS images of the sputtered surface showed the metallic Nd 3d (FIG. 15D) and Pr 3d (FIG. 15E) distribution on Pt electrode. The iron co-deposition was very small (<1%) as confirmed by Fe 2p core-level spectra before and after argon sputtering (FIG. 15F).
Figure 15B:
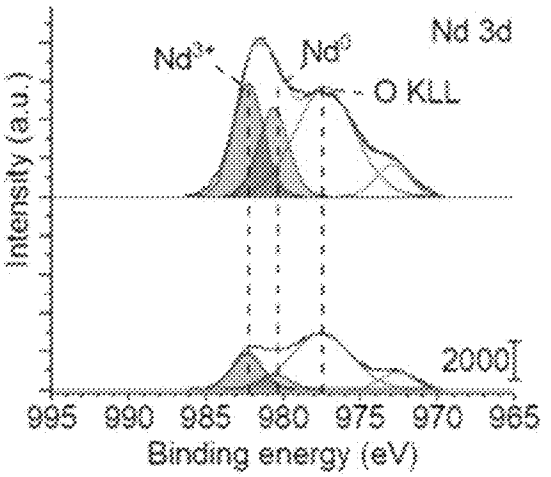
Figure 15C:
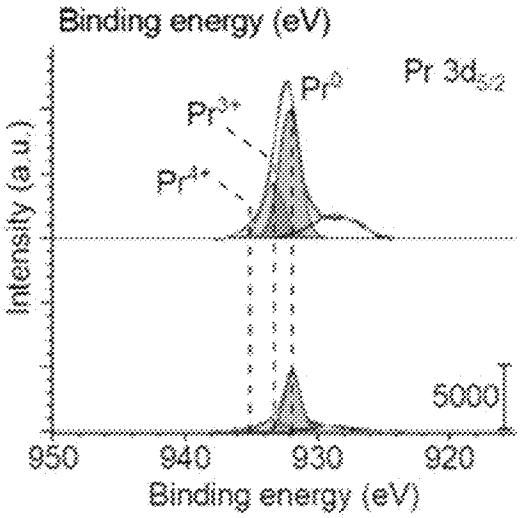

XPS analysis was performed to evaluate the chemical state of the electrodeposited alloy and any possible parasitic reaction products. The chemical compositional analysis derived from broad survey spectrum, shown in FIGS. 15A and 15F, reveals that the Fe content on the electrodeposited film was less than 1 at % along with Ag and Li representing the reference electrode and electrolyte components. Interestingly, a small quantity of Fe was detected only after 30 minutes of sputtering (FIG. 15F), even then the Fe 2p core level signal suggests the presence of $Fe^{2+}/Fe^{3+}$ ions rather than metallic iron. This suggests that the presence of iron is more likely to be surface chemisorption during the initial deposition process rather than continuous co-deposition with metallic lanthanides. Gd was not observed in the XPS spectrum, and the deposited layer was dominated by Nd and Pr, which corroborates the EDX analysis (FIG. $^{13}$C and Table 3).

TABLE 3

| SEM-EDX Analysis of Polished Nd—Fe—B Magnet | | | | | | |
|---|---|---|---|---|---|---|
| | Nd | Fe | Gd | Pr | O | Cu |
| a | 19.1 | 67.1 | 7.4 | 4.5 | 0.9 | 0.8 |
| b 1 | 52.8 | 9.6 | 6.9 | 15.9 | 0.7 | 14.2 |
| 2 | 36.4 | 25.1 | 14.4 | 8.1 | 14.7 | 1.4 |

The high-resolution Nd $3d_{5/2}$ and Pr $3d_{5/2}$ spectra (FIGS. 15D, 15E) show both metallic and oxide forms, albeit with different compositional ratios of 72 wt. % and 28 wt. % for Nd and Pr respectively. The presence of the oxide layer suggests two possible mechanisms, 1) electrolyte decomposition leading to interphase layer, and 2) surface oxidation during sample transfer to XPS measurements. It is expected that such procedural contamination during sample handling will be limited to oxidation of the surface layer and mostly unperturbed subsurface metallic layers.

Argon sputtering was performed to peel off the surface layer and probe the subsurface layers. After 5 min of sputtering, the metal component of both Nd and Pr significantly increased (about 500%) relative to the top surface layer. The significant drop in oxide components along the film depth suggests that most of the oxidation is attributable to procedural contamination and the electrolyte is stable enough to support a continuous metal deposition process. This result also corroborated the electrolyte stability evaluated by NMR analysis (FIGS. 10A-10C).

Figure 15D:
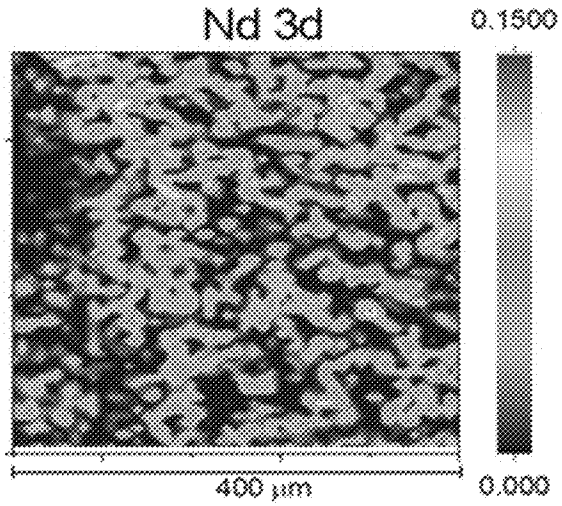
Figure 15E:
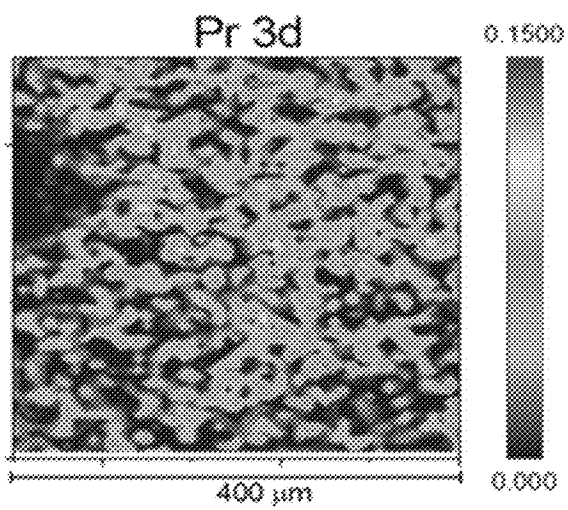
Figure 15F:
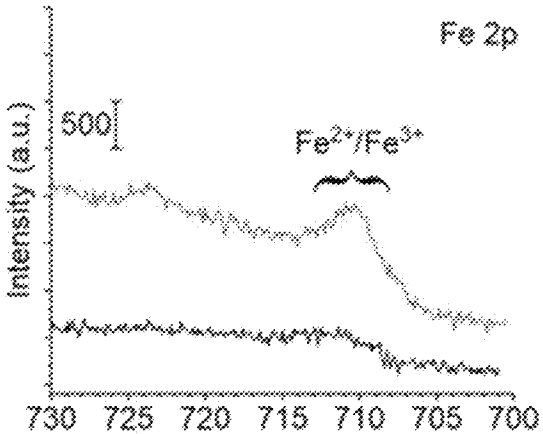

The presence of both Nd and Pr in metallic phase across the surface and subsurface suggested the possibility of didymium alloy formation during electrodeposition process. However, considering the clustered nucleation observed in SEM images (FIG. 13C), it is possible to have single phase Nd and Pr metal particles forming separately but closely distributed across the Pt electrode. To determine the chemical distribution of nucleated clusters, imaging XPS on Nd $3d_{5/2}$ and Pr $3d_{5/2}$ peak positions was performed as shown in FIGS. 15D and 15E. The clustering in the metal deposition is clear in XPS imaging, with the Nd and Pr distribution regimes mostly matching, albeit with different intensity, suggesting likely didymium alloy formation. However, considering the spectral resolution limits of both EDS and imaging XPS, it is possible to have individual metallic phase nucleation due to local chemical potential variations during plating process.

The foregoing results demonstrate a room-temperature one-pot electrochemical process that can selectively separate and concurrently deposit lanthanide elements as a metallic alloy from commercial Nd—Fe—B magnets. Selective electrochemical leaching of lanthanides from Nd—Fe—B was achieved in an aprotic organic solvent system which enabled concurrent electrodeposition of Ln-elements as a metallic alloy system. The electrochemical potential was evaluated as a control parameter to establish continuous leaching and deposition process under LiCl/DMF based electrolyte conditions. The spectroscopy and microscopy analysis of the deposition revealed a Nd—Pr based didymium alloy which can be easily used as feedstock in the production of new magnets and other rare earth metal-based products. Overall, the electrochemical methodology can be rapidly and sustainably scaled-up within existing industrial infrastructure and offers a viable waste-free and circular manufacturing of critical metals from electronic and industrial wastes.

In view of the many possible embodiments to which the principles of the disclosure may be applied, it should be recognized that the illustrated embodiments are only preferred examples and should not be taken as limiting the scope of the invention. Rather, the scope of the invention is defined by the following claims. We therefore claim as our invention all that comes within the scope and spirit of these claims.

We claim:

1. A method for selectively recovering a rare earth element (REE) from an alloy material comprising the REE, the method comprising:

applying a potential of from −3.5 V to 0 V to an electrochemical cell comprising an anode, a cathode, and an electrolyte, wherein (i) the anode comprises the alloy comprising the REE, (ii) the cathode comprises a noble metal, and (iii) the electrolyte comprises an alkali metal or alkaline earth metal salt and a nonaqueous organic solvent, to oxidatively dissolve at least a portion of the REE from the anode; and isolating an REE deposit from the alloy material, wherein the REE deposit is formed on the cathode.

2. The method of claim 1, further comprising selecting the potential by performing cyclic voltammetry over a potential range to determine a potential at which (i) selective oxidative dissolution of the REE occurs and (ii) REE deposition on the cathode occurs.

3. The method of claim 1, wherein the potential is effective to provide continuous oxidative dissolution of the REE at the anode and REE deposition at the cathode.

4. The method of claim 1, wherein the alloy comprises from 1 at % to 99 at % of the REE.

5. The method of claim 1, wherein the REE deposit comprises at least 95 at % of the REE.

6. The method of claim 1, wherein the REE comprises La, Ce, Pr, Nd, Pm, Sm, Eu, Gd, Tb, Dy, Ho, Er, Tm, Yb, Lu, or any combination thereof.

7. The method of claim 6, wherein the REE comprises Nd.

8. The method of claim 7, wherein the potential is from −3.5 V to −2.5 V.

9. The method of claim 1, wherein the anode comprises a Nd—Fe—B alloy.

10. The method of claim 9, wherein the Nd—Fe—B alloy further comprises Pr, and the REE deposit comprises Nd and Pr.

11. The method of claim 9, wherein the Nd—Fe—B alloy is obtained from a permanent magnet, the method further comprising demagnetizing the permanent magnet prior to applying the potential.

12. The method of claim 1, wherein the noble metal comprises Pt, Au, Ag, Ir, Os, Pd, Re, Ru, Rh, or any combination thereof.

13. The method of claim 12, wherein the noble metal comprises Pt or Au.

14. The method of claim 1, wherein a concentration of the alkali metal or alkaline earth metal salt is from 0.001 M to 1 M.

15. The method of claim 1, wherein the alkali metal or alkaline earth metal salt comprises a lithium salt, a sodium salt, a potassium salt, a cesium salt, or any combination thereof.

16. The method of claim 1, wherein the alkali metal or alkaline earth metal salt comprises LiCl, NaCl, $LiClO_4$, or any combination thereof.

17. The method of claim 1, wherein the nonaqueous organic solvent comprises dimethylformamide (DMF), an ether, or a combination thereof.

18. The method of claim 17, wherein the ether comprises 1,2-dimethoxyethane (DME), diethylene glycol dimethyl ether (DEGDME, or diglyme), triethylene glycol dimethyl ether (triglyme), tetraethylene glycol dimethyl ether (tetraglyme), 1,3-dioxolane (DOL), allyl ether, or any combination thereof.

19. A method for selectively recovering neodymium (Nd) from an alloy material comprising the Nd, the method comprising:

applying a potential of from −3.5 V to −2.5 V to an electrochemical cell comprising a anode, a cathode, and an electrolyte, wherein (i) the anode comprises the alloy comprising the Nd, (ii) the cathode comprises Pt or Au, and (iii) the electrolyte comprises 0.1 M to 1 M LiCl and a nonaqueous organic solvent comprising DMF or an ether, to oxidatively dissolve at least a portion of the Nd from the anode; and isolating an Nd deposit from the alloy material, wherein the Nd deposit is formed on the cathode.

20. The method of claim 19, wherein the anode comprises a demagnetized Nd—Fe—B alloy.

* * * * *